US009375933B2

(12) United States Patent
Kobashi et al.

(10) Patent No.: US 9,375,933 B2
(45) Date of Patent: Jun. 28, 2016

(54) LIQUID EJECTING APPARATUS

(71) Applicant: SEIKO EPSON CORPORATION, Tokyo (JP)

(72) Inventors: Masaru Kobashi, Matsumoto (JP); Sho Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/659,246

(22) Filed: Mar. 16, 2015

(65) Prior Publication Data

US 2015/0258795 A1 Sep. 17, 2015

(30) Foreign Application Priority Data

Mar. 17, 2014 (JP) ..... 2014-053144
Mar. 17, 2014 (JP) ..... 2014-053145
Mar. 17, 2014 (JP) ..... 2014-053146

(51) Int. Cl.
*B41J 2/165* (2006.01)

(52) U.S. Cl.
CPC ..... *B41J 2/16532* (2013.01); *B41J 2/16508* (2013.01); *B41J 2/16523* (2013.01); *B41J 2/16526* (2013.01)

(58) Field of Classification Search
CPC ..... B41J 2/16523; B41J 2/16532; B41J 2/16508; B41J 2/1652; B41J 2/16547; B41J 2/16526
USPC ..... 347/30
See application file for complete search history.

(56) References Cited

U.S. PATENT DOCUMENTS 5,504,508 A * 4/1996 Hashimoto ..... B41J 2/16523 347/24
6,068,364 A 5/2000 Kusumi et al.
6,511,153 B1 * 1/2003 Ishikawa ..... B41J 2/1652 347/35
2004/0104961 A1 * 6/2004 Hashi ..... B41J 2/16544 347/29
2006/0197818 A1 * 9/2006 Takatsuka ..... B41J 2/14233 347/104
2007/0252865 A1 * 11/2007 Sakurai ..... B41J 2/16508 347/29
2014/0240395 A1 * 8/2014 Shindo ..... B41J 2/16523 347/29

FOREIGN PATENT DOCUMENTS

| | | |
|---|---|---|
| JP | 07-290723 | 11/1995 |
| JP | 09-076529 | 3/1997 |
| JP | 10-146986 | 6/1998 |
| JP | 11-058753 | 3/1999 |
| JP | 2008-023781 | 2/2008 |
| JP | 2008-110520 | 5/2008 |
| JP | 2009-006726 | 1/2009 |

* cited by examiner

*Primary Examiner* — Alessandro Amari
*Assistant Examiner* — Yaovi M Ameh
(74) *Attorney, Agent, or Firm* — Workman Nydegger

(57) ABSTRACT

A liquid ejecting apparatus is provided with a liquid ejecting unit capable of ejecting liquid, a plurality of liquid holding portions capable of holding the liquid that is discharged from the liquid ejecting unit, and a suction mechanism which is connected to the plurality of liquid holding portions. The liquid holding portion includes a liquid reception portion which receives the liquid that is discharged from the liquid ejecting unit, a liquid reservoir portion capable of storing the liquid further down in a vertical direction than the liquid reception portion, and an atmosphere communicating portion which communicates the liquid reservoir portion with the atmosphere.

19 Claims, 9 Drawing Sheets

LIQUID EJECTING APPARATUS

BACKGROUND

1. Technical Field

The present invention relates to a liquid ejecting apparatus such as a printer.

2. Related Art

An ink jet printer which performs printing by discharging ink from nozzles provided in a recording head is an example of a liquid ejecting apparatus. Of such printers, there is a printer which includes a cap member for capping a recording head, an absorbing member accommodated in the cap member, and a suction mechanism which sucks the inside of the cap member, in which the printer performs suction cleaning that discharges ink in the recording head by performing suction via the cap member (for example, JP-A-2008-23781). In general, after the suction cleaning, the ink held in the absorbing member is discharged by performing idle suction in which the inside of the cap member is subjected to suction in an uncapped state.

However, in a printer similar to that described above, there is a case in which a plurality of cap members corresponding to different nozzle groups are provided, and suction cleaning is performed selectively on a portion of the nozzle groups. In this case, the amounts of ink held in the plurality of cap members differ.

When performing the idle suction by driving the suction mechanism connected to the plurality of cap members, the discharging completes in order from the cap member with the smallest amount of ink absorbed in the absorbing member. Therefore, in the cap members for which the ink discharging is completed, air is sucked via the absorbing members from which the ink is discharged, and there is a problem in that sufficient suction force may not be exerted on the cap members in which ink remains.

Note that, this problem is not limited to a cap member for capping, and is largely common to all liquid ejecting apparatuses provided with a plurality of liquid holding portions which temporarily hold liquid such as a flushing box that receives liquid that is discharged from nozzles, and a suction mechanism which sucks the plurality of liquid holding portions.

SUMMARY

An advantage of some aspects of the invention is to provide a liquid ejecting apparatus capable of efficiently discharging liquid held in a plurality of liquid holding portions connected to a suction mechanism.

Hereinafter, means of the invention and operation effects thereof will be described.

A liquid ejecting apparatus includes a liquid ejecting unit capable of ejecting a liquid; a plurality of liquid holding portions capable of holding the liquid that is discharged from the liquid ejecting unit; and a suction mechanism which is connected to the plurality of liquid holding portions, in which the liquid holding portion includes a liquid reception portion which receives the liquid that is discharged from the liquid ejecting unit, a liquid reservoir portion capable of storing the liquid further down in a vertical direction than the liquid reception portion, and an atmosphere communicating portion which communicates the liquid reservoir portion with the atmosphere.

In this case, after the liquid that is discharged from the liquid ejecting unit is received by the liquid reception portion, the liquid holding portion holds the liquid by storing the liquid in the liquid reservoir portion. Since the liquid reservoir portion communicates with the atmosphere via the atmosphere communicating portion, when the suction mechanism that is connected to the liquid holding portion is driven, in comparison to a case in which the liquid that is absorbed in an absorbing member formed of a porous material or the like is sucked, it is possible to quickly discharge the liquid that is stored in the plurality of liquid reservoir portions. Therefore, it is possible to efficiently discharge the liquid held in the plurality of liquid holding portions connected to the suction mechanism.

In the liquid ejecting apparatus, the liquid reception portion may be disposed to be suspended in a space within the liquid holding portion.

In this case, since the liquid reception portion is disposed to be suspended in the space within the liquid holding portion, the liquid received by the liquid reception portion flows down the liquid reception portion and is stored in the liquid reservoir portion. In other words, the liquid holding portion can hold the liquid for a period until the suction is performed by the suction mechanism by storing the liquid that is discharged from the liquid ejecting unit in the liquid reservoir portion.

In the liquid ejecting apparatus, ejecting ports capable of ejecting a liquid as droplets may be provided in the liquid ejecting unit, the liquid holding portion may be capable of forming a closed space to which the ejecting ports are open, and the liquid reception portion may be disposed in a position that opposes the ejecting ports when the liquid holding portion forms the closed space.

In this case, when the suction mechanism performs the suction of the closed space and the liquid is discharged from the ejecting ports, it is possible to remove the droplets that are adhered to the proximity of the ejecting ports of the liquid holding portion by causing the droplets to make contact with the liquid reception portion that is disposed in a position that opposes the ejecting ports. By disposing the liquid reception portion in a position that corresponds to the ejecting ports, when performing the flushing in which the droplets are ejected from the ejecting ports toward the liquid holding portion, the liquid that is ejected from the ejecting ports is received by the liquid reception portion before entering the liquid reservoir portion. Accordingly, since the flight distance of the droplets is shortened, it is possible to suppress the generation of mist that accompanies the flushing.

In the liquid ejecting apparatus, the liquid holding portion may include a bottom portion in which a communicating hole that communicates with the suction mechanism is opened, and a wall portion which is provided to stand on the bottom portion so as to surround the communicating hole, and a gap which forms the atmosphere communicating portion may be provided between the liquid reception portion and the wall portion.

In this case, since the liquid reservoir portion communicates with the atmosphere through the atmosphere communicating portion, which is formed of the gap formed between the liquid reception portion and the wall portion, when the suction mechanism connected to the liquid holding portion is driven, it is possible to quickly discharge the liquid that is stored in the liquid reservoir portion.

In the liquid ejecting apparatus, a through hole which forms the atmosphere communicating portion may be provided in the liquid reception portion.

In this case, since the liquid reservoir portion communicates with the atmosphere through the atmosphere communicating portion, which is formed of the through hole provided in the liquid reception portion, when the suction mechanism connected to the liquid holding portion is driven, it is possible to quickly discharge the liquid that is stored in the liquid reservoir portion.

In the liquid ejecting apparatus, the liquid holding portion may include a bottom portion in which a communicating hole that communicates with the suction mechanism is opened, and a wall portion which, by being provided to stand on the bottom portion, forms the liquid reservoir portion together with the bottom portion, and an atmosphere-open valve which configures the atmosphere communicating portion may be provided in the wall portion.

In this case, since it is possible to cause the liquid reservoir portion to communicate with the atmosphere by setting the atmosphere-open valve to the open-valve state, when the suction mechanism connected to the liquid holding portion is driven, it is possible to quickly discharge the liquid that is stored in the liquid reservoir portion.

Another liquid ejecting apparatus includes a liquid ejecting unit which includes ejecting ports capable of ejecting a liquid as droplets; a cap which forms a closed space containing the ejecting ports; a suction mechanism which causes the liquid to be discharged from the ejecting ports by subjecting the closed space to pressure reduction; and an atmosphere-open mechanism for communicating the closed space with the atmosphere, in which the cap includes a communicating hole which communicates with the atmosphere-open mechanism, and a liquid reception portion which is disposed between the ejecting ports and the communicating holes when forming the closed space.

In this case, when the closed space that is subjected to pressure reduction by the suction mechanism is communicated with the atmosphere, even if the liquid splashes together with the gas flowing in through the communicating hole, the splashed liquid is received by the liquid reception portion that is disposed between the communicating hole and the ejecting port. Accordingly, the occurrence of ejection faults caused by the splashed liquid destroying the liquid meniscus formed on the ejecting ports is suppressed. Therefore, it is possible to suppress the induction of ejection faults by the cleaning in which the liquid is discharged from the ejecting ports.

In the liquid ejecting apparatus, the cap may include a suction hole which communicates with the suction mechanism, a bottom portion in which the suction hole is opened, and a wall portion which is provided to stand on the bottom portion so as to surround the suction hole, the bottom portion and the wall portion may form a liquid reservoir portion capable of storing a liquid that is discharged from the ejecting ports, and the liquid reception portion may be disposed in a position that is distanced from the bottom portion.

In this case, when the suction mechanism is driven, the liquid stored in the liquid reservoir portion is discharged through a suction hole that is provided in the bottom portion that forms the liquid reservoir portion in the cap. Since the liquid reception portion is provided in a position that is distanced from the bottom portion, the liquid stored in the liquid reservoir portion may not be prevented from flowing toward the suction hole. Therefore, in comparison to a case in which the liquid that is absorbed in a liquid absorbing member accommodated in the cap is sucked, since the pressure loss when the liquid is discharged from inside the cap is reduced, a small degree of pressure reduction is sufficient for discharging the liquid. Therefore, it is possible to suppress the occurrence of splashing of the liquid together with the flowing in of gas by reducing the energy of the gas that flows in through the communicating hole when the closed space is opened to the atmosphere.

In the liquid ejecting apparatus, the liquid reception portion may be disposed so as to partition the closed space into a first region, which is on the liquid ejecting unit side, and a second region, which is on the bottom portion side and has a greater volume than the first region, the first region and the second region may communicate with each other through a gap that is provided between the liquid reception portion and the wall portion, and the communicating hole may be provided to be open to the second region.

In this case, when the suction mechanism is driven, the second region to which the suction hole is open is subjected to pressure reduction, and the first region is subsequently subjected to pressure reduction through the gap that is provided between the liquid reception portion and the wall portion. Since the first region is partitioned from the second region by the liquid reception portion, the second region has a lower pressure than the first region during the pressure reduction. When the atmosphere-open mechanism communicates the closed space with the atmosphere, the second region to which the communicating hole is open is opened to the atmosphere first. At this time, since the first region is partitioned from the second region even if the liquid splashes in the second region together with the gas that flows in from the communicating hole, the splashing of the liquid does not easily reach the liquid ejecting unit which is in the first region. Since the degree of pressure reduction of the first region is less than that of the second region, the energy of the gas that flows into the first region from the second region through the gap that is provided between the liquid reception portion and the wall portion is reduced. Therefore, even if the liquid splashes due to the energy of the gas flowing into the first region, the occurrence of the liquid adhering to the liquid ejecting unit is suppressed.

In the liquid ejecting apparatus, the liquid reception portion may include a curved surface in a position that opposes the communicating hole, and the curved surface is a convex shape so as to protrude toward the communicating hole.

In this case, the liquid that splashes with the energy of the gas that flows in through the communicating hole when the closed space is communicated with the atmosphere is received by the curved surface of the liquid reception portion, which is convex-shaped so as to protrude toward the communicating hole, and the liquid subsequently flows along the curved surface. Accordingly, the occurrence of the liquid splashing with the energy of hitting the liquid reception portion and adhering to the liquid ejecting unit is suppressed.

In the liquid ejecting apparatus, the liquid reception portion may include a curved surface in a position that opposes the communicating hole, and the curved surface may be a concave shape so as to be concave toward the ejecting port side.

In this case, the liquid that splashes with the energy of the gas that flows in through the communicating hole when the closed space is communicated with the atmosphere is received by the concave curved surface of the liquid reception portion, and the liquid subsequently flows along the curved surface. Accordingly, the occurrence of the liquid splashing with the energy of hitting the liquid reception portion and adhering to the liquid ejecting unit is suppressed.

In the liquid ejecting apparatus, the liquid reception portion is disposed in a position that opposes the ejecting ports when the cap forms the closed space.

In this case, when the cap forms the closed space, since the liquid reception portion is disposed in a position that opposes the ejecting ports, it is possible to suppress the adherence of the liquid in relation to the ejecting ports using the liquid reception portion regardless of the flow direction of the liquid that flows in through the communicating hole when the closed space is communicated with the atmosphere.

In the liquid ejecting apparatus, the cap may include a bottom portion in which the communicating hole is opened, a wall portion which is provided to stand on the bottom portion, and a lip portion which is provided on a top edge of the wall portion and forms the closed space by making contact with the liquid ejecting unit so as to surround the ejecting ports, and the communicating hole may be provided in a position abutting the wall portion.

In this case, since the communicating hole is provided in a position abutting the wall portion of the cap, the flow direction of the gas that flows in through the communicating hole when the closed space is communicated with the atmosphere does not easily intersect the direction to which the ejecting ports are open. Therefore, it is possible to suppress the occurrence of the liquid that splashes together with the flowing in of the gas adhering to the ejecting ports.

Still another liquid ejecting apparatus includes a liquid ejecting unit in which a plurality of nozzle rows, which include a plurality of nozzles capable of ejecting liquid and which are formed by the plurality of nozzles being lined up in a first direction, are provided to line up in a second direction that intersects the first direction; a cap which forms a closed space to which the plurality of nozzles are open; and a liquid reception portion which is disposed within the cap, in which, when the cap forms the closed space, a plurality of reception regions that oppose the nozzle rows are provided in the liquid reception portion to correspond to the nozzle rows, and in which the plurality of reception regions are disposed to leave an interval in the second direction such that spaces are formed in positions that oppose regions between one of the nozzle rows of the liquid ejecting unit and another.

In this case, since the liquid reception portion that is disposed within the cap includes a plurality of the reception regions that face the nozzle rows when the cap forms the closed space, the liquid that flows out from the nozzles can be received by the reception regions. The plurality of reception regions are disposed at an interval in the second direction that intersects the first direction such that the spaces are formed in positions that oppose the regions in which the nozzle rows of the liquid reception portion are not formed. In other words, since the liquid reception portion is not disposed in a position that opposes the region in which the nozzle rows of the liquid ejecting unit are not formed, even if the bubble is formed when the cap separates from the liquid ejecting unit, the bubble is split by the space formed between the reception regions in the second direction, and the diameter of the bubble is small. Accordingly, since the swelling of the bubble in the direction toward the nozzles is suppressed, it is possible to suppress the occurrence of the bubble that is formed when the cap separates from the liquid ejecting unit adhering to the nozzles.

In the liquid ejecting apparatus, the cap may include a bottom portion in which a discharge hole for discharging the liquid within the cap is opened, and a wall portion which is provided to stand on the bottom portion so as to surround the discharge hole, and the discharge hole may communicate with the spaces.

In this case, since the discharge hole that is formed in the bottom portion of the cap communicates with the spaces that are formed between one of the reception regions and another in the second direction, when the liquid that is discharged from the nozzles is stored in the spaces, it is possible to discharge the liquid to the outside of the cap through the discharge hole.

In the liquid ejecting apparatus, the second direction may be a direction that is perpendicular to the first direction.

In this case, since the plurality of reception regions that extend in the first direction are disposed to line up in the second direction that is perpendicular to the first direction, it is possible to reliably secure the space between one of the reception regions and another that line up in the second direction.

In the liquid ejecting apparatus, the cap may include a bottom portion in which a discharge hole for discharging the liquid within the cap is opened, and a wall portion which is provided to stand on the bottom portion so as to surround the discharge hole, and the liquid reception portion may be disposed in a position that is distanced from the bottom portion.

In this case, since the liquid reception portion is disposed in a position that is distanced from the bottom portion, it is possible to cause the liquid that is stored in the cap to flow out through the discharge hole quicker than when the liquid reception portion is disposed in a position abutting the bottom portion.

A configuration may be adopted in which, in the liquid ejecting apparatus, when a distance between the reception region and the liquid ejecting unit when the cap forms the closed space is Lg, and a length of the reception region in the second direction is La, $La/2<Lg$.

When the semi-spherical bubble is formed between the reception region and the liquid ejecting unit such that the end portion makes contact with the outer edge of the reception region, the wider the area of the reception region, the greater the maximum radius of the bubble that adheres to the same reception region. For example, when the length of the reception region in the second direction is La, the maximum radius of the bubble that is adhered to the reception region is La/2. When the liquid ejecting unit approaches the reception region to which the bubble is adhered, the likelihood that the bubble will make contact with the liquid ejecting unit increases. To address this point, according to the configuration described above, when the cap approaches the liquid ejecting unit and forms the closed space, since the distance Lg between the reception region and the liquid ejecting unit is greater than La/2, which is the radius of the bubble, the occurrence of the bubble making contact with the liquid ejecting unit is suppressed.

A configuration may be adopted in which, in the liquid ejecting apparatus, the first direction and the second direction may be directions that intersect with an ejecting direction in which the nozzles eject the liquid, and, when a length of the reception region in the second direction is La, and a length of the liquid reception portion in the ejecting direction is Lb, $Lb<La$.

In this case, it is possible to decrease the size in the ejecting direction of the cap in which the liquid reception portion is disposed by reducing the length of the reception region in the ejecting direction.

In the liquid ejecting apparatus, the liquid reception portion may be formed of a porous material.

In this case, the liquid that is received by the liquid reception portion formed of a porous material may be absorbed into the liquid reception portion through the holes formed in the liquid reception portion, pass through the liquid reception portion, and the like. Therefore, when the liquid reception portion receives the liquid, it is possible to suppress the occurrence the liquid storing on the upper surface, which serves as the reception surface, of the liquid reception portion and making contact with the nozzles.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of an embodiment of the liquid ejecting apparatus with reference to the drawings. The liquid ejecting apparatus is, for example, an ink jet printer that performs recording (printing) by ejecting ink onto a medium such as paper. The ink is an example of a liquid.

First Embodiment

Figure 1:
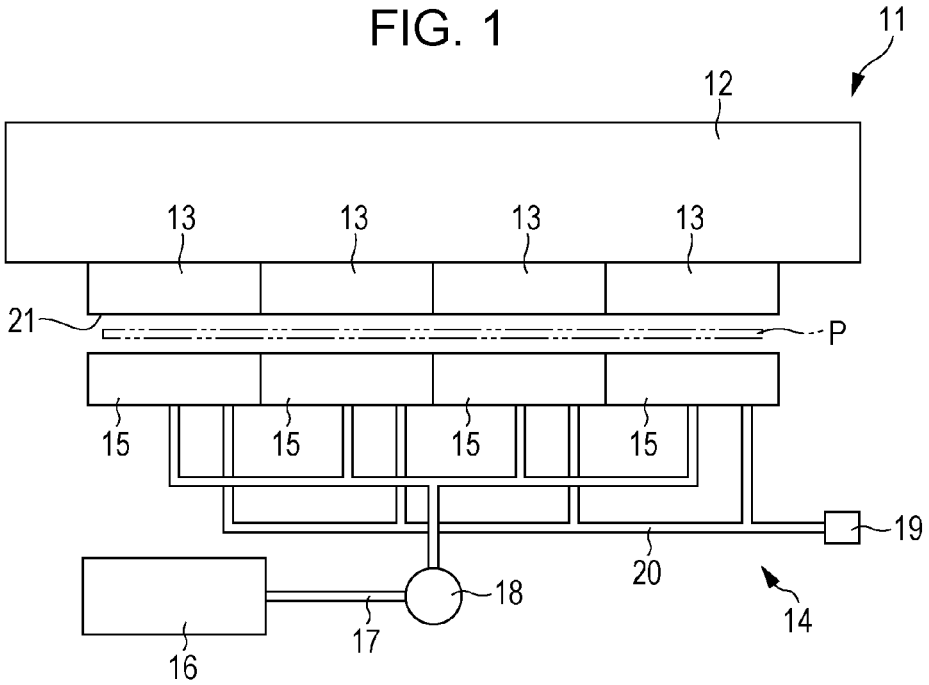
FIG. 1 is a schematic diagram illustrating a configuration of a liquid ejecting apparatus of a first embodiment.

As illustrated in FIG. 1, a liquid ejecting apparatus 11 is provided with a plurality of liquid ejecting units 13 held by a holding body 12, and a maintenance apparatus 14. The liquid ejecting units 13 perform recording (printing) by ejecting liquid onto a medium P.

The maintenance apparatus 14 is provided with a plurality of liquid holding portions 15, a collection body 16, a discharge flow path 17, a suction mechanism 18, an atmosphere-open valve 19, and an atmosphere-open flow path 20. The plurality of liquid holding portions 15 are provided to correspond to the liquid ejecting units 13, the collection body 16 is capable of storing liquid, the discharge flow path 17 connects the collection body 16 to the plurality of liquid holding portions 15, the suction mechanism 18 is disposed in a position part way down the discharge flow path 17, and the atmosphere-open flow path 20 connects the atmosphere-open valve 19 to the plurality of liquid holding portions 15.

Note that, the discharge flow path 17 branches into a plurality of paths at the upstream side that is connected to the liquid holding portions 15, and the suction mechanism 18 is disposed at a portion of the discharge flow path 17 on the downstream side, where the discharge flow path 17 is not branched. In other words, the plurality of liquid holding portions 15 are connected to the suction mechanism 18 via the discharge flow path 17. The atmosphere-open flow path 20 branches into a plurality of paths at the side connected to the liquid holding portion 15, and the atmosphere-open valve 19 is disposed at a portion of the atmosphere-open flow path 20 that is not branched. In other words, the plurality of liquid holding portions 15 are connected to the atmosphere-open valve 19 via the atmosphere-open flow path 20.

Figure 2:
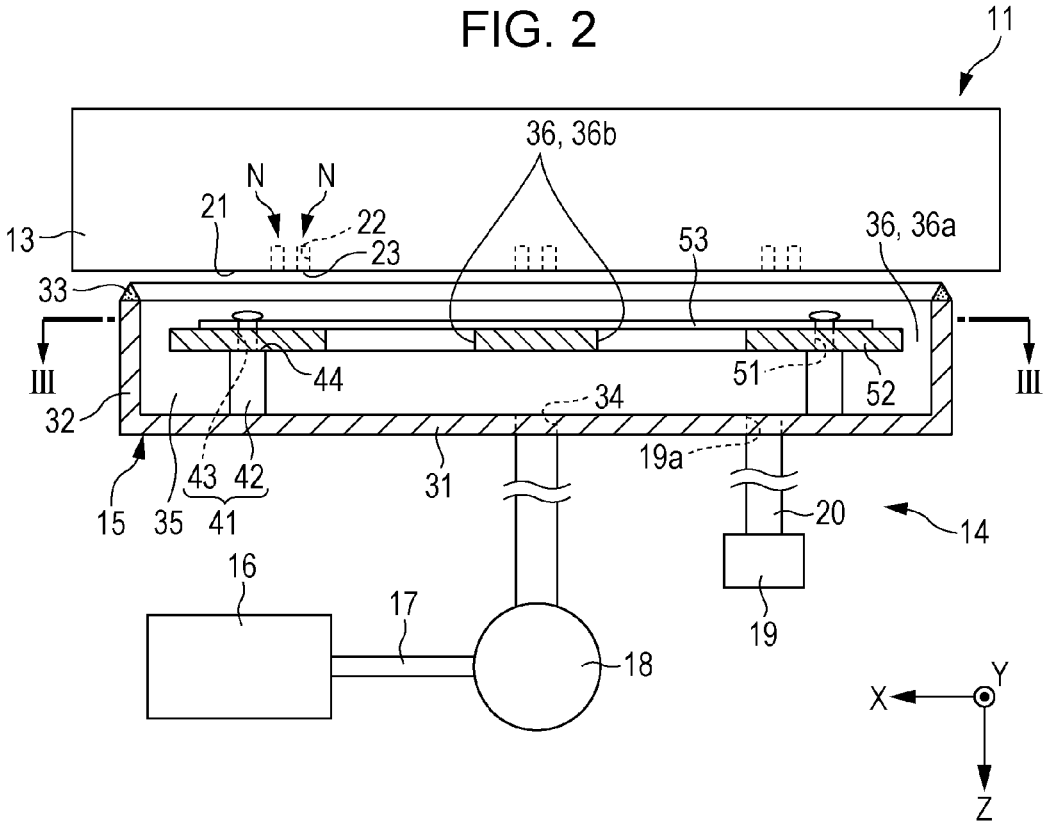
FIG. 2 is a schematic diagram illustrating the configuration of the same liquid ejecting apparatus using a partial cross-sectional diagram.

As illustrated in FIG. 2, a plurality of ejecting ports 23 is formed in an opening surface 21 provided in the liquid ejecting unit 13. The ejecting ports 23 are the openings of nozzles 22 capable of ejecting liquid as droplets. A plurality of the nozzles 22 are provided in the liquid ejecting unit 13 so as to line up in a direction X (the left direction in FIG. 2) and a direction Y (the direction outward from the paper surface in FIG. 2) intersecting the direction X. In the present embodiment, the direction X and the direction Y are depicted as directions which are perpendicular to a gravity direction Z; however, the angles of intersection of the direction X, the direction Y, and the gravity direction Z can be changed arbitrarily.

Figure 3:
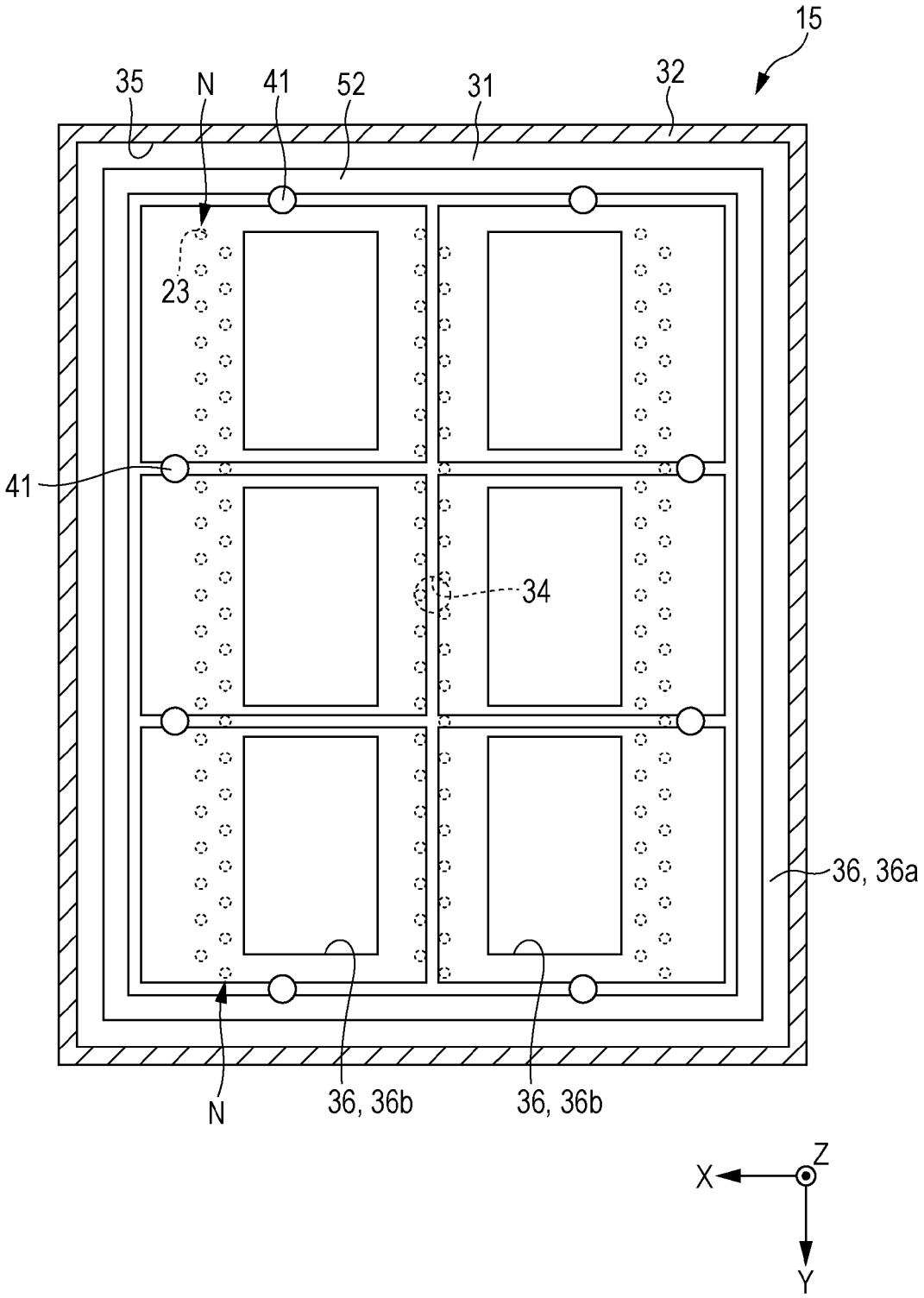
FIG. 3 is a cross-sectional view taken along line III-III in FIG. 2.

The plurality of nozzles 22 lined up in the direction Y form a nozzle row N (also refer to FIG. 3). A plurality of the nozzle rows N is disposed at a predetermined interval in the direction X. In the present embodiment, a situation is exemplified in which the nozzle rows N are disposed at a predetermined interval in the direction X two rows at a time; however, the nozzle rows N may be disposed at a predetermined interval in the direction X one row at a time, and may be disposed at a predetermined interval in the direction X in single units of three or more rows.

The liquid holding portion 15 of the present embodiment includes a bottom portion 31, a wall portion 32, and an elastically deformable lip portion 33, and is a cap having the shape of a box including a bottom in which the lip portion 33 forms an opening portion. The upstream end of the discharge flow path 17 and the atmosphere-open flow path 20 are connected to the bottom portion 31, the wall portion 32 is provided to stand on the bottom portion 31, and the lip portion 33 is provided on the top edge of the wall portion 32.

A communicating hole 34 that communicates with the suction mechanism 18 via the discharge flow path 17 is opened in the proximity of the center of the bottom portion 31 in the liquid holding portion 15. In other words, the communicating hole 34 is a suction hole which communicates with the suction mechanism 18. A communicating hole 19*a* which communicates with the atmosphere-open valve 19 is opened in the bottom portion 31. The wall portion 32 is provided to stand up from the bottom portion 31 so as to surround the communicating hole 34 and the communicating hole 19*a*.

Of the liquid holding portion 15 and the liquid ejecting unit 13, when one moves in a direction approaching the other, the lip portion 33 makes contact with the opening surface 21 so as to surround the plurality of ejecting ports 23, and the lip portion 33 surrounds the liquid holding portion 15 and the opening surface 21 to form a closed space therebetween. Forming the closed space to which the ejecting ports 23 are open using the liquid holding portion 15 in this manner is referred to as "capping". When the liquid holding portion 15 moves relatively in a direction going away from the liquid ejecting unit 13, the uncapping is performed.

Note that, the target that the liquid holding portion 15 makes contact with when performing the capping is not limited to the opening surface 21. For example, it is possible to form the closed space to which the ejecting ports 23 are open by causing the side portions of the liquid ejecting unit 13 or the holding body 12 that holds the liquid ejecting unit 13 to make contact with the liquid holding portion 15.

When the liquid ejecting unit 13 is capped by the liquid holding portion 15 and the suction mechanism 18 is driven in a state in which the atmosphere-open valve 19 is closed, the suction cleaning in which liquid is discharged from the liquid ejecting unit 13 through the ejecting ports 23 is executed by the closed space being subjected to pressure reduction and assuming negative pressure. In other words, the suction mechanism 18 causes the liquid to be discharged from the ejecting ports 23 by reducing the pressure of the closed space.

When, for example, the nozzles 22 become clogged or the like, and a liquid ejection fault occurs, the suction cleaning is performed as a maintenance operation for alleviating such an ejection fault. Therefore, the liquid that is discharged from the ejecting ports 23 by the suction cleaning contains bubbles that enter the liquid ejecting unit 13, a concentrated solute component, or the like. The liquid that is discharged from the ejecting ports 23 in the suction cleaning is collected in the collection body 16 through the discharge flow path 17 as waste liquid.

Note that, after executing the suction cleaning, the uncapping is performed by causing the liquid holding portion 15 to move relatively in a direction going away from the liquid ejecting unit 13 after releasing the negative pressure of the closed space by setting the atmosphere-open valve 19 to the open-valve state. Subsequently, the idle suction in which the liquid being held by the liquid holding portion 15 is discharged into the collection body 16 through the discharge flow path 17 is performed by setting the atmosphere-open valve 19 to a closed-valve state and driving the suction mechanism 18.

The closed space is communicated with the atmosphere due to the atmosphere-open valve 19 entering the open-valve state. Note that, a tube pump that includes a rotating member which rotates while crushing a tube, which serves as the discharge flow path 17, can be used as the suction mechanism 18, for example. In this case, it is possible to open the closed space to the atmosphere by releasing the tube from the crushing by the rotating member. In this case, since the suction mechanism 18 functions as an atmosphere-open mechanism, the atmosphere-open flow path 20 and the atmosphere-open valve 19 may not be provided. When the atmosphere-open valve 19 is provided in the discharge flow path 17, it is possible to open the closed space to the atmosphere by opening the atmosphere-open valve 19. In this manner, when it is possible to cause the suction mechanism 18 to function as an atmosphere-open mechanism, since the communicating hole 34 also communicates with the atmosphere-open mechanism, the communicating hole 19*a* may not be provided in the bottom portion 31.

In the liquid ejecting apparatus 11, there is a case in which flushing is performed as a maintenance operation for alleviating ejection faults. In the flushing, the liquid ejecting unit 13 ejects droplets from the ejecting ports 23 toward the liquid holding portion 15. Note that, the idle suction in which the liquid being held by the liquid holding portion 15 is discharged into the collection body 16 through the discharge flow path 17 is performed by driving the suction mechanism 18 after performing the flushing.

A plurality of support shafts 41 are provided on the bottom portion 31 of the liquid holding portion 15 to protrude therefrom. The support shaft 41 includes a shaft portion 42 provided on the base side, and an insert portion 43 provided on the tip side. The insert portion 43 has a smaller diameter than the shaft portion 42, and a step surface 44 is formed between the shaft portion 42 and the insert portion 43.

A plate-shaped liquid reception portion 52 is accommodated inside the liquid holding portion 15. An insert hole 51 is provided in the liquid reception portion 52 in a position corresponding to the support shaft 41. In an embodiment in which the insert portion 43 is inserted into the insert hole 51 and is mounted on the step surface 44, the liquid reception portion 52 is supported by the support shafts 41. However, the liquid reception portion 52 may not necessarily be supported by the support shafts 41; for example, the liquid reception portion 52 may be engaged with protruding portions that are provided to protrude from the wall portion 32. In other words, the liquid reception portion 52 may be disposed to be suspended in the space within the liquid holding portion 15 in a state in which a gap is provided between the liquid reception portion 52 and the bottom portion 31.

In the liquid reception portion 52, it is preferable to retain a surface of the opposite side from the surface that is mounted on the step surfaces 44 (the top surface in FIG. 2), for example, using a frame member 53 formed of metal or the like. If the liquid reception portion 52 is retained by the frame member 53 in this manner, even when the liquid reception portion 52 expands or deforms, the contact between the liquid reception portion 52 and the opening surface 21 is suppressed. It is possible to fix the liquid reception portion 52 and the frame member 53 to the support shafts 41 by warping the tips of the support shafts 41 that are inserted into the liquid reception portion 52 and the frame member 53 into spherical shapes using heat or the like.

When the liquid holding portion 15 forms the closed space, the liquid reception portion 52 is disposed in a position between the ejecting ports 23 and the communicating hole 34 that is opened in the bottom portion 31, which is a position in which the liquid reception portion 52 is suspended to oppose the ejecting ports 23 and the communicating hole 34. Accordingly, when performing the suction cleaning, the liquid reception portion 52 receives the liquid that is discharged from the liquid ejecting unit 13. Note that, the flushing is normally performed in an uncapped state (the state illustrated in FIG. 2); however, since the liquid reception portion 52 is provided in a position corresponding to the ejecting ports 23, the liquid that is ejected from the liquid ejecting unit 13 during the flushing is received by the liquid reception portion 52.

The bottom portion 31 and the wall portion 32 of the liquid holding portion 15 form a liquid reservoir portion 35 capable of storing liquid that is discharged from the ejecting ports 23 lower in the vertical direction than the liquid reception portion 52. The liquid that is received by the liquid reception portion 52 during the suction cleaning and the flushing flows down the liquid reception portion 52 and is stored in the liquid reservoir portion 35. In other words, the liquid holding portion 15 holds the liquid for a period until the suction is performed by the suction mechanism 18 by storing the liquid that is discharged from the liquid ejecting unit 13 in the liquid reservoir portion 35.

A gap 36*a* which forms an atmosphere communicating portion 36 that communicates the liquid reservoir portion 35 with the atmosphere is provided between the liquid reception portion 52 and the wall portion 32. Through holes 36*b* which form the atmosphere communicating portion 36 that communicates the liquid reservoir portion 35 with the atmosphere are provided in the liquid reception portion 52. Note that, it is not necessary to provide both the gap 36*a* and the through holes 36*b*, and only one may be provided.

As illustrated in FIG. 3, it is preferable that the through holes 36*b* be disposed in a position that does not oppose the ejecting ports 23 when forming the closed space or when performing the flushing. For example, in the present embodiment, a configuration is adopted in which the through holes 36*b* are disposed in positions that fall between one nozzle row N and another in the direction X when forming the closed space.

Next, description will be given of the operations of the liquid ejecting apparatus 11, which is configured as described above.

In the liquid ejecting apparatus 11, when the suction cleaning is performed, there is a case in which the liquid that is discharged from the nozzles 22 remains as droplets adhered to the opening surface 21. At this time, the droplets are removed from the opening surface 21 by the liquid reception portion 52 that is disposed to oppose the ejecting ports 23 making contact with the droplets that are adhered to the opening surface 21.

When performing the flushing, the droplets that are ejected from the nozzles 22 are received by the liquid reception portion 52 before entering the liquid reservoir portion 35. When the flushing is performed, a fine mist is generated together with the droplets, and there is a case in which the fine mist adheres to the opening surface 21. When the mist gradually increases in size on the opening surface 21 and becomes droplets, these enlarged droplets make contact with the droplets that are ejected from the nozzles 22 and cause the flight direction of the ejected droplets to change, and there is a case in which the print quality is reduced. To address this point, if the droplets of the flushing are received by the liquid reception portion 52 that is disposed to be suspended between the opening surface 21 and the bottom portion 31, it is possible to suppress the generation of mist by the amount that it is possible to shorten the flight distance of the droplets that are ejected from the nozzles 22; therefore, this is preferable.

When the suction is performed after the suction cleaning and the flushing, the liquid is sucked from the plurality of liquid holding portions 15 connected to the suction mechanism 18 at the same time, as illustrated in FIG. 1. At this time, since, in the liquid holding portion 15, the liquid is stored in the liquid reservoir portion 35 that communicates with the atmosphere via the atmosphere communicating portion 36, in comparison to a case in which the liquid is held in a liquid absorber such as a porous material that blocks the whole surface of the opening portion of the liquid reservoir portion 35, for example, the pressure loss when the liquid flows toward the communicating hole 34 is small.

Furthermore, since the liquid that is stored in the respective liquid reservoir portions 35 of the plurality of liquid holding portions 15 communicates with the atmosphere via the atmosphere communicating portion 36, between the plurality of liquid holding portions 15, even if there is a difference in the remaining amounts of the liquid to be suctioned in the liquid reservoir portions 35, no difference in pressure loss occurs between the liquid holding portions 15 in a process in which the liquid flows toward the communicating hole 34. Therefore, even when the plurality of liquid holding portions 15 are connected to the suction mechanism 18, it is possible to quickly discharge the liquid from the plurality of liquid holding portions 15.

Note that, the liquid reception portion 52 is disposed in a position that is distanced from the communicating hole 34 that communicates with the suction mechanism 18; therefore, the suction force of the suction mechanism 18 does not easily reach the liquid reception portion 52. Therefore, it is preferable to configure the liquid reception portion 52 using a material that does not easily hold liquid. For example, it is preferable to adopt a configuration in which, even when the liquid reception portion 52 is formed using a porous material, the bubbles (cavities) of the inner portion are large, continuous or the like, and the absorbed liquid is discharged under its own weight.

According to the embodiment described above, it is possible to obtain the following effects.

(1) After the liquid that is discharged from the liquid ejecting unit 13 is received by the liquid reception portion 52, the liquid holding portion 15 holds the liquid by storing the liquid in the liquid reservoir portion 35. Since the liquid reservoir portion 35 communicates with the atmosphere via the atmosphere communicating portion 36, when the suction mechanism 18 that is connected to the liquid holding portion 15 is driven, in comparison to a case in which the liquid that is absorbed in an absorbing member formed of a porous material or the like that blocks the whole surface of the opening portion of the liquid reservoir portion 35 is sucked, it is possible to quickly discharge the liquid that is stored in the plurality of liquid reservoir portions 35. Therefore, it is possible to efficiently discharge the liquid held in the plurality of liquid holding portions 15 connected to the suction mechanism 18.

(2) Since the liquid reception portion 52 is disposed to be suspended in the space within the liquid holding portion 15, the liquid received by the liquid reception portion 52 flows down the liquid reception portion 52 and is stored in the liquid reservoir portion 35. In other words, the liquid holding portion 15 can hold the liquid for a period until the suction is performed by the suction mechanism 18 by storing the liquid that is discharged from the liquid ejecting unit 13 in the liquid reservoir portion 35.

(3) When the suction mechanism 18 performs the suction of the closed space and the liquid is discharged from the ejecting ports 23, it is possible to remove the droplets that are adhered to the proximity of the ejecting ports 23 of the liquid holding portion 15 by causing the droplets to make contact with the liquid reception portion 52 that is disposed in a position that opposes the ejecting ports 23. By disposing the liquid reception portion 52 in a position that corresponds to the ejecting ports 23, when performing the flushing in which the droplets that are ejected from the ejecting ports 23 toward the liquid holding portion 15, the liquid that is ejected from the ejecting ports 23 is received by the liquid reception portion 52 before entering the liquid reservoir portion 35. Accordingly, since the flight distance of the droplets ejected from the nozzles 22 is shortened, it is possible to suppress the generation of mist that accompanies the flushing.

(4) Since the liquid reservoir portion 35 communicates with the atmosphere through the atmosphere communicating portion 36, which is formed of the gap 36*a* formed between the liquid reception portion 52 and the wall portion 32, when the suction mechanism 18 connected to the liquid holding portion 15 is driven, it is possible to quickly discharge the liquid that is stored in the liquid reservoir portion 35.

(5) Since the liquid reservoir portion 35 communicates with the atmosphere through the atmosphere communicating portion 36, which is formed of the through hole 36*b* provided in the liquid reception portion 52, when the suction mechanism 18 connected to the liquid holding portion 15 is driven, it is possible to quickly discharge the liquid that is stored in the liquid reservoir portion 35.

Note that, the embodiment described above can also be modified as described below.

Figure 4:
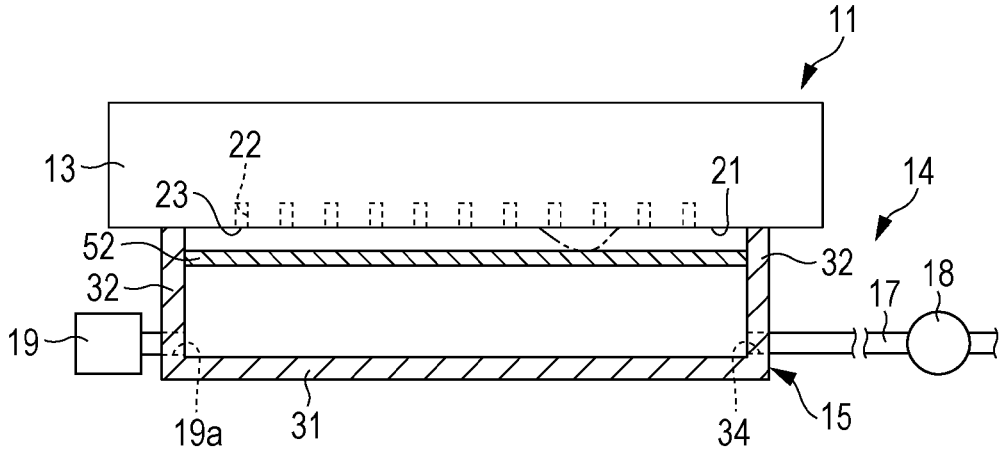
FIG. 4 is a schematic diagram illustrating a first modification example of a liquid ejecting apparatus.

As in the first modification example illustrated in FIG. 4, the atmosphere-open valve 19 that configures the atmosphere communicating portion may be provided in the wall portion 32 of the liquid holding portion 15. In this case, since it is possible to cause the liquid reservoir portion 35 to communicate with the atmosphere by setting the atmosphere-open valve 19 to the open-valve state, when the suction mechanism 18 connected to the liquid holding portion 15 is driven, it is possible to quickly discharge the liquid that is stored in the liquid reservoir portion 35.

As in the first modification example illustrated in FIG. 4, the communicating hole 34 that communicates with the suction mechanism 18 may be provided in the wall portion 32. Note that, as illustrated in FIG. 4, when the communicating hole 34 that communicates with the suction mechanism 18 is disposed in a position that opposes the communicating hole 19*a* that communicates with the atmosphere-open valve 19, since it is possible to cause gas that flows in from the communicating hole 19*a* to flow toward the communicating hole 34 when the idle suction is performed, it is possible to quickly discharge the liquid of the entire inside of the liquid holding portion 15.

As in the first modification example illustrated in FIG. 4, it is possible to configure the liquid reception portion 52 using a mesh-shaped member such as wire netting or a textile, for example. If this configuration is adopted, since the sieve-holes in a mesh that holds the liquid less easily than a porous material or the like and has large sieve-holes function as the atmosphere communicating portion, the gap 36*a* may not be provided between the liquid reception portion 52 and the wall portion 32, and the through holes 36*b* may not be provided in the liquid reception portion 52. If a mesh-shaped liquid reception portion 52 is adopted in this manner, it is possible to arbitrarily change the position of the ejecting ports 23 as illustrated in FIG. 4.

In other words, the liquid reception portion 52 may be capable of making contact with the droplets after the suction cleaning as illustrated by the double-dot-dash line in FIG. 4 or receiving the droplets during the flushing; therefore, the liquid reception portion 52 may be formed using a material that does not absorb the liquid. However, if the liquid reception portion 52 is capable of absorbing the liquid, it is possible to quickly remove the droplets from the opening surface 21 after the suction cleaning, to suppress the rebounding of the droplets received during the flushing, and the like.

Figure 5:
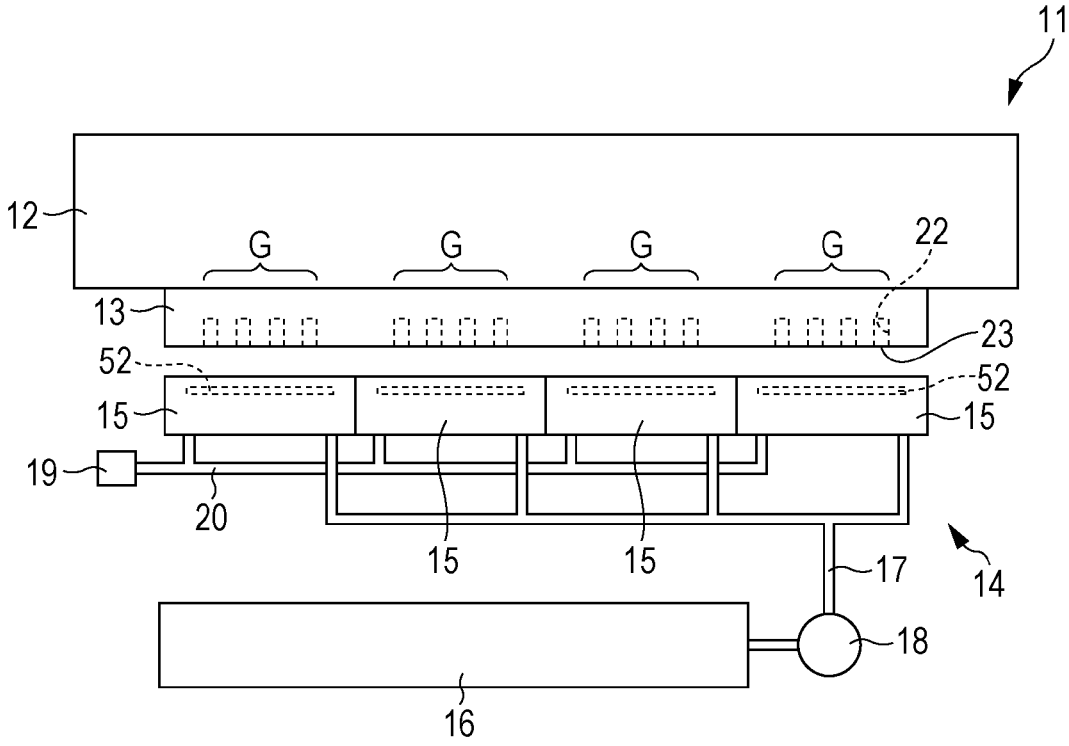
FIG. 5 is a schematic diagram illustrating a second modification example of a liquid ejecting apparatus.

As in the second modification example illustrated in FIG. 5, the plurality of liquid holding portions 15 may be provided to correspond to a plurality of nozzle groups G formed on one of the liquid ejecting units 13. In other words, it is possible to arbitrarily change the number and disposition of the liquid ejecting units 13 and the nozzles 22.

As in the second modification example illustrated in FIG. 5, it is possible to arbitrarily change the connecting positions of the discharge flow path 17 and the atmosphere-open flow path 20 in relation to the liquid holding portion 15.

The liquid holding portion 15 is not limited to being a cap for capping. For example, the liquid holding portion 15 may be a flushing box which receives the droplets that are ejected from the liquid ejecting unit 13 during the flushing. Alternatively, when performing borderless-printing in which printing is carried out without leaving a margin at the border of the medium P, it is possible to adopt the liquid holding portion 15 as a liquid holding portion for receiving the ink droplets that fall outside of the border of the medium. When the capping is not performed using the liquid holding portion 15, the liquid holding portion 15 may not be provided with the lip portion 33, and may not be provided with the atmosphere-open valve 19 (the atmosphere-open mechanism).

Second Embodiment

Figure 6:
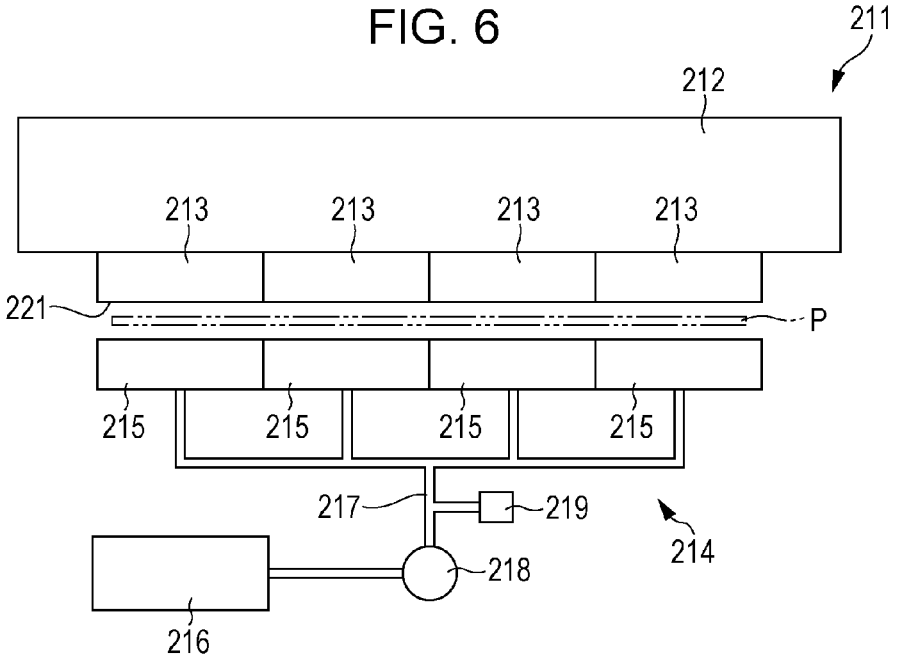
FIG. 6 is a schematic diagram illustrating a configuration of a liquid ejecting apparatus of a second embodiment.

As illustrated in FIG. 6, a liquid ejecting apparatus 211 is provided with a plurality of liquid ejecting units 213 held by a holding body 212, and a maintenance apparatus 214. The liquid ejecting units 213 perform recording (printing) by ejecting liquid onto the medium P.

The maintenance apparatus 214 is provided with a plurality of caps 215, a collection body 216, a discharge flow path 217, a suction mechanism 218, and an atmosphere-open valve 219. The plurality of caps 215 are provided to correspond to the liquid ejecting units 213, the collection body 216 is capable of storing liquid, the discharge flow path 217 connects the collection body 216 to the plurality of caps 215, and the suction mechanism 218 is disposed in a position part way down the discharge flow path 217. The atmosphere-open valve 219 is disposed in a position part way down the discharge flow path 217, between the suction mechanism 218 and the cap 215. Note that, the discharge flow path 217 branches into a plurality of paths at the upstream side that is connected to the caps 215, and the suction mechanism 218 and the atmosphere-open valve 219 are disposed at a portion of the discharge flow path 217 on the downstream side, where the discharge flow path 217 is not branched. In other words, the plurality of caps 215 are connected to the suction mechanism 218 via the discharge flow path 217.

Figure 7:
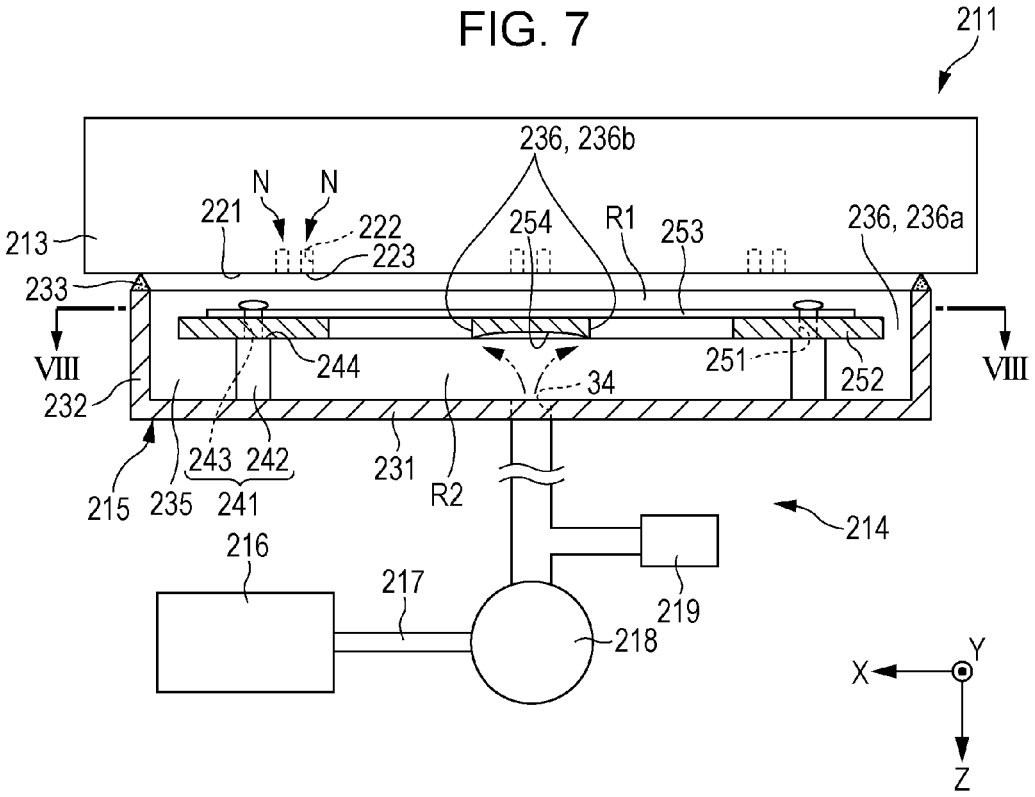
FIG. 7 is a schematic diagram illustrating the configuration of the same liquid ejecting apparatus using a partial cross-sectional diagram.

As illustrated in FIG. 7, a plurality of ejecting ports 223 is formed in an opening surface 221 provided in the liquid ejecting unit 213. The ejecting ports 223 are the openings of nozzles 222 capable of ejecting liquid as droplets. A plurality of the nozzles 222 are provided in the liquid ejecting unit 213 so as to line up in the direction X (the left direction in FIG. 7) and the direction Y (the direction outward from the paper surface in FIG. 7) intersecting the direction X. In the present embodiment, the direction X and the direction Y are depicted as directions which are perpendicular to a gravity direction Z; however, the angles of intersection of the direction X, the direction Y, and the gravity direction Z can be changed arbitrarily.

Figure 8:
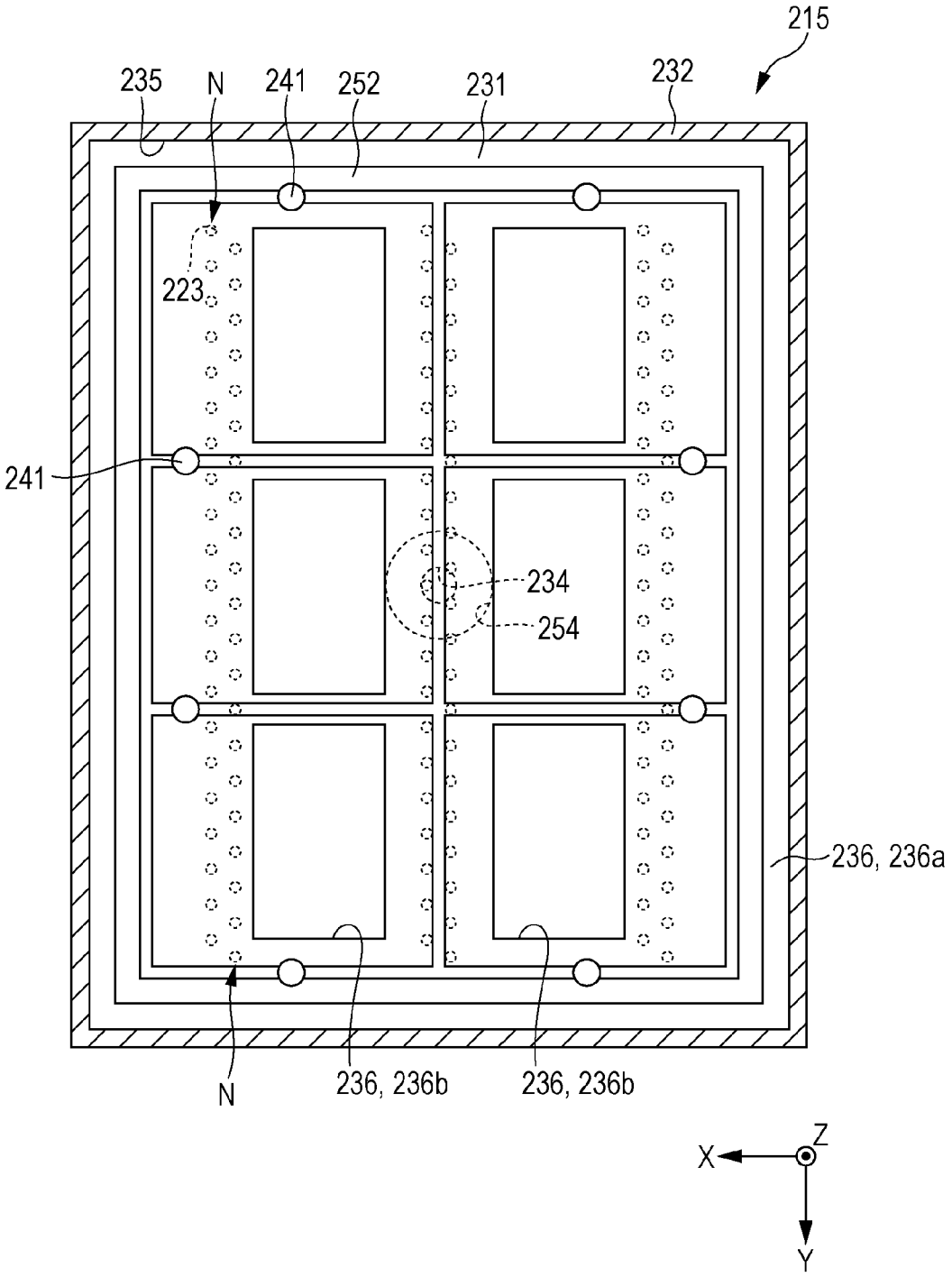
FIG. 8 is a cross-sectional view taken along line VIII-VIII in FIG. 7.

The plurality of nozzles 222 lined up in the direction Y form the nozzle row N (also refer to FIG. 8). A plurality of the nozzle rows N is disposed at a predetermined interval in the direction X. In the present embodiment, a situation is exemplified in which the nozzle rows N are disposed at a predetermined interval in the direction X two rows at a time; however, the nozzle rows N may be disposed at a predetermined interval in the direction X one row at a time, and may be disposed at a predetermined interval in the direction X in single units of three or more rows.

The cap 215 of the present embodiment includes a bottom portion 231, a wall portion 232, and an elastically deformable lip portion 233, and has the shape of a box including a bottom in which the lip portion 233 forms an opening portion. The upstream end of the discharge flow path 217 is connected to the bottom portion 231, the wall portion 232 is provided to stand on the bottom portion 231, and the lip portion 233 is provided on the top edge of the wall portion 232.

A communicating hole 234 that communicates with the atmosphere-open valve 219 and the suction mechanism 218, which serve as an atmosphere-open mechanism, via the discharge flow path 217 is opened in the proximity of the center of the bottom portion 231 in the cap 215. In other words, the communicating hole 234 is a suction hole which communicates with the suction mechanism 218. The wall portion 232 is provided to stand up from the bottom portion 231 so as to surround the communicating hole 234 (also refer to FIG. 8).

Of the cap 215 and the liquid ejecting unit 213, when one moves in a direction approaching the other, the lip portion 233 makes contact with the opening surface 221 so as to surround the plurality of ejecting ports 223, and the lip portion 233 surrounds the cap 215 and the opening surface 221 to form a closed space therebetween. Note that, forming the closed space to which the ejecting ports 223 are open using the cap 215 in this manner is referred to as "capping". When the cap 215 moves in a direction going away from the liquid ejecting unit 213, the uncapping is performed.

Note that, the target that the cap 215 makes contact with when performing the capping is not limited to the opening surface 221. For example, it is possible to form the closed space to which the ejecting ports 223 are open by causing the side portions of the liquid ejecting unit 213 or the holding body 212 that holds the liquid ejecting unit 213 to make contact with the cap 215.

When the liquid ejecting unit 213 is capped by the cap 215 and the suction mechanism 218 is driven in a state in which the atmosphere-open valve 219 is closed, the suction cleaning in which liquid is discharged from the liquid ejecting unit 213 through the ejecting ports 223 is executed by the closed space being subjected to pressure reduction and assuming negative pressure. In other words, the suction mechanism 218 causes the liquid to be discharged from the ejecting ports 223 by reducing the pressure of the closed space.

When, for example, the nozzles 222 become clogged or the like, and a liquid ejection fault occurs, the suction cleaning is performed as a maintenance operation for alleviating such an ejection fault. Therefore, the liquid that is discharged from the ejecting ports 223 by the suction cleaning contains bubbles that enter the liquid ejecting unit 213, a solute component with increased viscosity, or the like. The liquid that is discharged from the ejecting ports 223 in the suction cleaning is collected in the collection body 216 through the discharge flow path 217 as waste liquid.

Note that, after executing the suction cleaning, the uncapping is performed by causing the cap 215 to move relatively in a direction going away from the liquid ejecting unit 213 after releasing the negative pressure of the closed space by setting the atmosphere-open valve 219 to the open-valve state. Subsequently, the idle suction in which the liquid being held by the cap 215 is discharged into the collection body 216 through the discharge flow path 217 is performed by setting the atmosphere-open valve 219 to the closed-valve state and driving the suction mechanism 218.

In other words, the closed space is communicated with the atmosphere through the communicating hole 234 due to the atmosphere-open valve 219 entering the open-valve state. Note that, a tube pump that includes a rotating member which rotates while crushing a tube, which serves as the discharge flow path 217, can be used as the suction mechanism 218, for example. In this case, it is possible to open the closed space to the atmosphere by releasing the tube from the crushing by the rotating member. When the suction mechanism 218 functions as an atmosphere-open mechanism, the atmosphere-open valve 219 may not be provided.

There is a case in which flushing is performed as a maintenance operation for alleviating ejection faults. In the flushing, the liquid ejecting unit 213 ejects the droplets from the ejecting ports 223 toward the cap 215. Note that, the idle suction in which the liquid being held by the cap 215 is discharged into the collection body 216 through the discharge flow path 217 is performed by driving the suction mechanism 218 after performing the flushing.

A plurality of support shafts 241 are provided on the bottom portion 231 of the cap 215 to protrude therefrom. The support shaft 241 includes a shaft portion 242 provided on the base side, and an insert portion 243 provided on the tip side. The insert portion 243 has a smaller diameter than the shaft portion 242, and a step surface 244 is formed between the shaft portion 242 and the insert portion 243.

A plate-shaped liquid reception portion 252 is accommodated inside the cap 215. An insert hole 251 is provided in the liquid reception portion 252 in a position corresponding to the support shaft 241. In an embodiment in which the insert portion 243 is inserted into the insert hole 251 and is mounted on the step surface 244, the liquid reception portion 252 is supported by the support shafts 241. However, the liquid reception portion 252 may not necessarily be supported by the support shafts 241; for example, the liquid reception portion 252 may be engaged with protruding portions that are provided to protrude from the wall portion 232.

In the liquid reception portion 252, it is preferable to retain a surface of the opposite side from the surface that is mounted on the step surfaces 244 (the top surface in FIG. 7), for example, using a frame member 253 formed of metal or the like. If the liquid reception portion 252 is retained by the frame member 253 in this manner, even when the liquid reception portion 252 expands or deforms, the contact between the liquid reception portion 252 and the opening surface 221 is suppressed. It is possible to fix the liquid reception portion 252 and the frame member 253 to the support shafts 241 by warping the tips of the support shafts 241 that are inserted into the liquid reception portion 252 and the frame member 253 into spherical shapes using heat or the like.

When the cap 215 forms the closed space, the liquid reception portion 252 is disposed in a position between the ejecting ports 223 and the communicating hole 234 that is opened in the bottom portion 231, which is a position in which the liquid reception portion 252 is suspended to oppose the ejecting ports 223 and the communicating hole 234 (also refer to FIG. 8). Accordingly, when performing the suction cleaning, the liquid reception portion 252 receives the liquid that is discharged from the liquid ejecting unit 213. Note that, the flushing is normally performed in the uncapped state; however, since the liquid reception portion 252 is provided in a position corresponding to the ejecting ports 223, the liquid that is ejected from the liquid ejecting unit 213 during the flushing is received by the liquid reception portion 252.

The bottom portion 231 and the wall portion 232 of the cap 215 form a liquid reservoir portion 235 capable of storing liquid that is discharged from the ejecting ports 223 lower in the vertical direction than the liquid reception portion 252. The liquid that is received by the liquid reception portion 252 during the suction cleaning and the flushing flows down the liquid reception portion 252 and is stored in the liquid reservoir portion 235. In other words, the cap 215 holds the liquid for a period until the suction is performed by the suction mechanism 218 by storing the liquid that is discharged from the liquid ejecting unit 213 in the liquid reservoir portion 235. Note that, the liquid reception portion 252 may include a curved surface 254 in a position that opposes the communicating hole 234. The curved surface 254 is a concave shape so as to be concave toward the ejecting port 223 side.

A gap 236*a* which forms an atmosphere communicating portion 236 that communicates the liquid reservoir portion 235 with the atmosphere is provided between the liquid reception portion 252 and the wall portion 232. Through holes 236*b* which form the atmosphere communicating portion 236 that communicates the liquid reservoir portion 235 with the atmosphere are provided in the liquid reception portion 252. Note that, it is not necessary to provide both the gap 236*a* and the through holes 236*b*, and only one may be provided.

It is preferable that the liquid reception portion 252 be provided in a position that is distanced from the bottom portion 231. It is preferable that the liquid reception portion 252 be disposed so as to partition the closed space into a first region R1 and a second region R2. The first region R1 is on the liquid ejecting unit 213 side, and the second region R2 is on the bottom portion 231 side and has a greater volume than the first region R1. In this case, the embodiment is such that the first region R1 and the second region R2 communicate with each other through the gap 236*a* and the through holes 236*b* that are provided between the liquid reception portion 252 and the wall portion 232, and the communicating hole 234 is open to the second region R2.

As illustrated in FIG. 8, it is preferable that the through holes 236*b* be disposed in a position that does not oppose the ejecting ports 223 when forming the closed space. For example, in the present embodiment, a configuration is adopted in which the through holes 236*b* are disposed in positions that fall between one nozzle row N and another in the direction X when forming the closed space.

Next, description will be given of the operations of the liquid ejecting apparatus 211, which is configured as described above.

The liquid ejecting unit 213 is capped by the cap 215 and the suction mechanism 218 is driven in a state in which the atmosphere-open valve 219 is closed when performing the suction cleaning. Therefore, the second region R2 to which the communicating hole 234 that communicates with the suction mechanism 218 communicates is open first assumes a negative pressure, and the first region R1 subsequently assumes a negative pressure through the gap 236*a* and the through hole 236*b*. Therefore, after the liquid flows out from the ejecting ports 223 that are open to the first region R1 and is received by the liquid reception portion 252, the liquid flows down the liquid reception portion 252 and is stored in the liquid reservoir portion 235.

When the driving of the suction mechanism 218 stops, the negative pressure of the first region R1 and the second region R2 is gradually released by the liquid being discharged from the nozzles 222, and the liquid that flows out from the ejecting ports 223 enters a state of remaining in the liquid reservoir portion 235 of the cap 215.

Subsequently, the closed space is opened to the atmosphere by setting the atmosphere-open valve 219 to the closed-valve state in order to perform the idle suction in which the liquid within the cap 215 is discharged. At this time, as illustrated by the double-dot-dash line in FIG. 7, there is a case in which the liquid remaining in the liquid reservoir portion 235 splashes within the closed space due to gas energetically flowing into the closed space through the communicating hole 234.

When the liquid that splashes hits the ejecting ports 223, the liquid meniscus formed within the ejecting ports 223 is broken and there is a concern that this will cause droplet discharge faults; therefore, this is not preferable. To address this point, in the present embodiment, since the liquid reception portion 252 is provided between the communicating hole 234 and the ejecting ports 223 so as to block the liquid that splashes from the communicating hole 234, the liquid that splashes from the communicating hole 234 does not easily hit the ejecting ports 223.

When the liquid reception portion 252 is partitioning the closed space into the first region R1 and the second region R2, the degree of negative pressure is more likely to increase in the second region R2 to which the communicating hole 234 that communicates with the suction mechanism 218 are open than in the first region R1. Therefore, when the closed space is opened to the atmosphere, in comparison to the energy of the gas that flows into the second region R2 from the communicating hole 234 that communicates with the atmosphere-open valve 219, the energy of the gas that flows into the first region R1 from the second region R2 is reduced.

Since the ejecting ports 223 are open to the first region R1 and the liquid reception portion 252 is disposed in a position that opposes the ejecting ports 223, when the gas flows into the first region R1, the liquid that splashes due to the energy thereof does not easily hit the ejecting ports 223. Accordingly, a problem in which the suction cleaning that is performed in order to alleviate droplet ejection faults conversely induces ejection faults does not occur easily.

Furthermore, when the liquid reception portion 252 includes a curved surface 254 in a position that opposes the communicating hole 234, the liquid that splashes from the communicating hole 234 hits the curved surface 254, and flows along the shape of the curve; therefore, the liquid flows down toward the liquid reservoir portion 235. Accordingly the liquid that splashes from the communicating hole 234 and hits the curved surface 254 does not splash in excess of the region of the curved surface 254, and does not easily splash toward the ejecting ports 223.

Note that, in the liquid ejecting apparatus 211, when the suction cleaning is performed, after the closed space is opened to the atmosphere, there is a case in which the liquid that is discharged from the nozzles 222 remains as droplets adhered to the opening surface 221. At this time, the droplets are removed from the opening surface 221 by the liquid reception portion 252 that is disposed to oppose the ejecting ports 223 making contact with the droplets that are adhered to the opening surface 221.

When performing the flushing, the droplets that are ejected from the nozzles 222 are received by the liquid reception portion 252 before entering the liquid reservoir portion 235. When the flushing is performed, a fine mist is generated together with the droplets, and there is a case in which the fine mist adheres to the opening surface 221. When the mist gradually increases in size on the opening surface 221 and becomes droplets, these enlarged droplets make contact with the droplets that are ejected from the nozzles 222 and cause the flight direction of the ejected droplets to change, and there is a case in which the print quality is reduced. To address this point, if the droplets of the flushing are received by the liquid reception portion 252 that is disposed to be suspended between the opening surface 221 and the bottom portion 231, it is possible to suppress the generation of mist by the amount that it is possible to shorten the flight distance of the droplets that are ejected from the nozzles 222; therefore, this is preferable.

When the idle suction is performed after the suction cleaning and the flushing, the liquid is sucked from the plurality of caps 215 connected to the suction mechanism 218 at the same time, as illustrated in FIG. 6. At this time, since, in the cap 215, the liquid is stored in the liquid reservoir portion 235 that communicates with the atmosphere via the atmosphere communicating portion 236, in comparison to a case in which the liquid is held in a liquid absorber such as a porous material that blocks the whole surface of the opening portion of the liquid reservoir portion 235, for example, the pressure loss when the liquid flows toward the communicating hole 234 is small.

Furthermore, since the liquid that is stored in the respective liquid reservoir portions 235 of the plurality of caps 215 communicates with the atmosphere via the atmosphere communicating portion 236, between the plurality of caps 215, even if there is a difference in the remaining amounts of the liquid to be suctioned in the liquid reservoir portions 235, no difference in pressure loss occurs between the caps 215 in a process in which the liquid flows toward the communicating hole 234. Therefore, even when the plurality of caps 215 are connected to the suction mechanism 218, it is possible to quickly discharge the liquid from the plurality of caps 215.

Note that, the liquid reception portion 252 is disposed in a position that is distanced from the communicating hole 234 that communicates with the suction mechanism 218; therefore, the suction force of the suction mechanism 218 does not easily reach the liquid reception portion 252. In other words, since the liquid reception portion 252 is disposed to be suspended in the space within the cap 215 in a state in which a gap is provided between the liquid reception portion 252 and the bottom portion 231, the suction force of the suction mechanism 218 does not easily reach the liquid reception portion 252. Therefore, it is preferable to configure the liquid reception portion 252 using a material that does not easily absorb liquid. For example, it is preferable to adopt a configuration in which, even when the liquid reception portion 252 is formed using a porous material, the bubbles (cavities) of the inner portion are large, continuous or the like, and the absorbed liquid is discharged under its own weight.

In this manner, since the liquid reception portion 252 may not absorb and hold the liquid, it is not necessary to increase the volume of the liquid reception portion 252; however, it is preferable to dispose the liquid reception portion 252 so as to make contact with the droplets adhered to the opening surface 221 during the suction cleaning. Therefore, in the present embodiment, the plate-shaped liquid reception portion 252 is disposed in a position closer to the lip portion 233 than the bottom portion 231. As a result, in the closed space, the volume of the second region R2 which is on the bottom portion 231 side is greater than that of the first region R1 which is on the liquid ejecting unit 213 side, and it is possible to store more of the liquid in the second region R2.

According to the embodiment described above, it is possible to obtain the following effects.

(1) When the closed space that is subjected to pressure reduction by the suction mechanism 218 is communicated with the atmosphere, even if the liquid splashes together with the gas flowing in through the communicating hole 234, the splashed liquid is received by the liquid reception portion 252 that is disposed between the communicating hole 234 and the ejecting port 223 so as to block the liquid that splashes from the communicating hole 234. Accordingly, the occurrence of ejection faults caused by the splashed liquid destroying the liquid meniscus formed on the ejecting ports 223 is suppressed. Therefore, it is possible to suppress the induction of ejection faults by the cleaning in which the liquid is discharged from the ejecting ports 223.

(2) When the suction mechanism 218 is driven, the liquid stored in the liquid reservoir portion 235 is discharged through the communicating hole 234, which is a suction hole that is provided in the bottom portion 231 that forms the liquid reservoir portion 235 in the cap 215. Since the liquid reception portion 252 is provided to be suspended in a position that is distanced from the bottom portion 231, the liquid stored in the liquid reservoir portion 235 may not be prevented from flowing toward the communicating hole 234. Therefore, in comparison to a case in which the liquid that is absorbed in a liquid absorbing member accommodated in the whole cap 215 is sucked, since the pressure loss when the liquid is discharged from inside the cap 215 is reduced, a small degree of pressure reduction is sufficient for discharging the liquid. Therefore, it is possible to suppress the occurrence of splashing of the liquid together with the flowing in of gas by reducing the energy of the gas that flows in through the communicating hole 234 when the closed space is opened to the atmosphere.

(3) When the suction mechanism 218 is driven, the second region R2 to which the communicating hole 234 is open is subjected to pressure reduction, and the first region R1 is subsequently subjected to pressure reduction through the gap 236*a* that is provided between the liquid reception portion 252 and the wall portion 232. Since the first region R1 is partitioned from the second region R2 by the liquid reception portion 252, the second region R2 has a lower pressure than the first region R1 during the pressure reduction. When the atmosphere-open valve 219, which is the atmosphere-open mechanism, is opened and the closed space is communicated with the atmosphere, the second region R2 to which the communicating hole 234 is open is opened to the atmosphere first. At this time, since the first region R1 is partitioned from the second region R2 even if the liquid splashes in the second region R2 together with the gas that flows in from the communicating hole 234, the splashing of the liquid does not easily reach the liquid ejecting unit 213 which is in the first region R1. Since the degree of pressure reduction of the first region R1 is less than that of the second region R2, the energy of the gas that flows into the first region R1 from the second region R2 through the gap 236*a* that is provided between the liquid reception portion 252 and the wall portion 232 is reduced. Therefore, even if the liquid splashes due to the energy of the gas flowing into the first region R1, the occurrence of the liquid adhering to the liquid ejecting unit 213 is suppressed.

(4) The liquid that splashes with the energy of the gas that flows in through the communicating hole 234 when the closed space is communicated with the atmosphere is received by the concave curved surface 254 of the liquid reception portion 252, and subsequently flows along the curved surface 254 into the range of a region of the curved surface 254. Accordingly, the occurrence of the liquid splashing with the energy of hitting the liquid reception portion 252 and adhering to the liquid ejecting unit 213 is suppressed.

(5) When the cap 215 forms the closed space, since the liquid reception portion 252 is disposed in a position that opposes the ejecting ports 223, it is possible to suppress the adherence of the liquid in relation to the ejecting ports 223 using the liquid reception portion 252 regardless of the flow direction of the liquid that flows in through the communicating hole 234 when the closed space is communicated with the atmosphere.

Note that, the embodiment described above can also be modified as described below.

Figure 9:
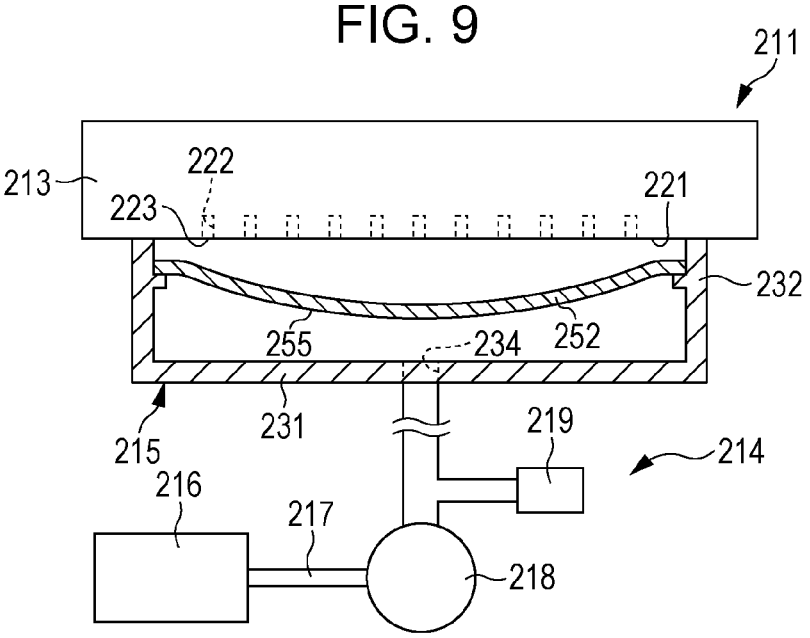
FIG. 9 is a schematic diagram illustrating a third modification example of a liquid ejecting apparatus.

As in the third modification example illustrated in FIG. 9, it is possible to configure the liquid reception portion 252 using a mesh-shaped member such as wire netting or a textile that holds the liquid less easily than a porous material or the like and has large sieve-holes, for example. If this configuration is adopted, since the liquid reservoir portion 235 communicates with the atmosphere through the sieve-holes in the mesh, the gap 236*a* may not be provided between the liquid reception portion 252 and the wall portion 232, and the through holes 236*b* may not be provided in the liquid reception portion 252. If a mesh-shaped liquid reception portion 252 is adopted in this manner, it is possible to arbitrarily change the position of the ejecting ports 223 in the liquid ejecting unit 213 as illustrated in FIG. 9.

In other words, the liquid reception portion 252 may be capable of making contact with the droplets after the suction cleaning or receiving the droplets during the flushing; therefore, the liquid reception portion 252 may be formed using a material that does not absorb the liquid. However, if the liquid reception portion 252 is capable of absorbing the liquid, it is possible to quickly remove the droplets from the opening surface 221 during the suction cleaning, to suppress the rebounding of the droplets received during the flushing, and the like.

As in the third modification example illustrated in FIG. 9, the liquid reception portion 252 may include a curved surface 255 in a position that opposes the communicating hole 234. The curved surface 255 is a convex shape so as to protrude toward the communicating hole 234. Note that, by supporting the end portion of the liquid reception portion 252 using the wall portion 232 or the like, the curved surface 255 may be formed by the proximity of the center of the liquid reception portion 252 flexing in the gravity direction due to its own weight, and the curved surface 255 may be formed by causing the portion of the liquid reception portion 252 that opposes the communicating hole 234 to protrude. The liquid reception portion 252 that includes the convex curved surface 255 is not limited to being configured by a mesh-shaped member such as wire netting, and it is possible to form the convex curved surface 255 in the plate-shaped liquid reception portion 252 formed of a resin, for example.

In this case, the liquid that splashes with the energy of the gas that flows in through the communicating hole 234 when the closed space is communicated with the atmosphere is received by the curved surface 255 of the liquid reception portion 252, which is convex-shaped so as to protrude toward the communicating hole 234, and the liquid subsequently flows along the curved surface 255. Accordingly, the occurrence of the liquid splashing with the energy of hitting the liquid reception portion 252 and adhering to the liquid ejecting unit 213 is suppressed.

Figure 10:
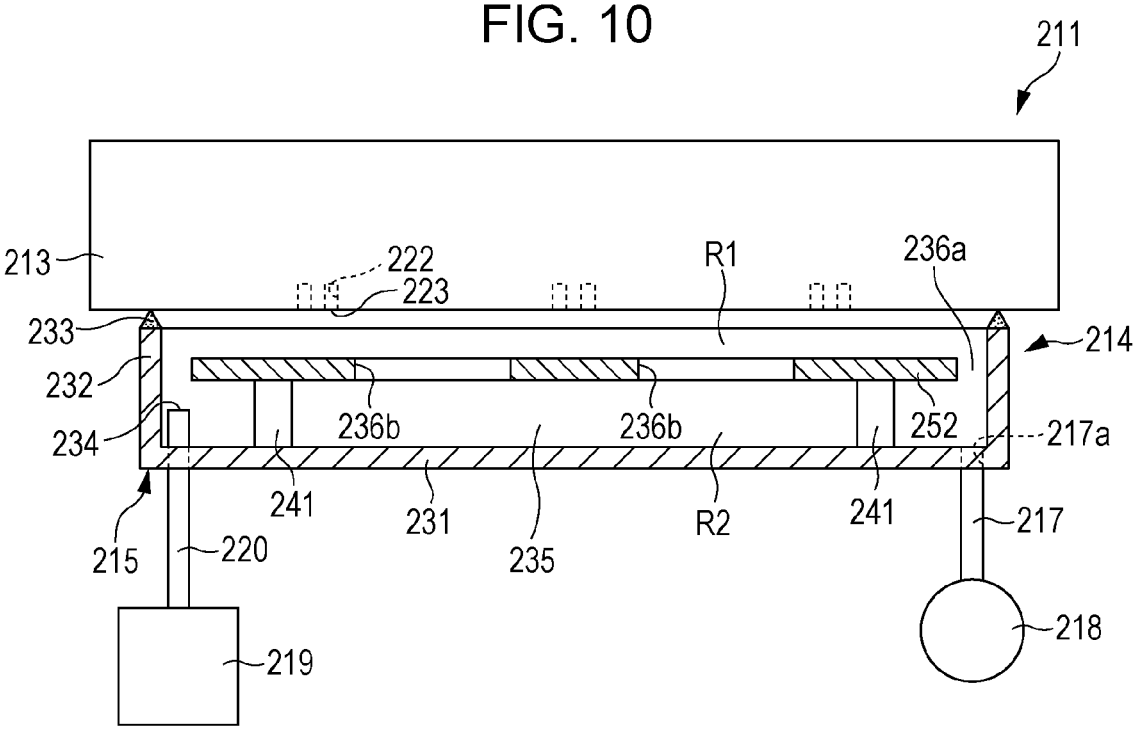
FIG. 10 is a schematic diagram illustrating a fourth modification example of a liquid ejecting apparatus.

As in the fourth modification example illustrated in FIG. 10, the liquid ejecting apparatus 211 may be configured to be provided with the liquid ejecting unit 213 and the cap 215, one of each.

As in the fourth modification example illustrated in FIG. 10, the discharge flow path 217 that communicates with the suction mechanism 218 and the atmosphere-open flow path 220 that communicates with the atmosphere-open valve 219 may be connected to the cap 215, and a suction hole 217*a* that communicates with the suction mechanism 218 and a communicating hole 234 that communicates with the atmosphere-open valve 219 may be opened in the bottom portion 231. In this case, it is preferable that the communicating hole 234 be opened in a position higher than the bottom portion 231 so as to suppress the occurrence of the liquid stored in the liquid reservoir portion 235 flowing into the atmosphere-open flow path 220. It is preferable that the communicating hole 234 be provided in a position abutting the wall portion 232 or a position close to the wall portion 232.

If this configuration is adopted, since the communicating hole 234 is provided in a position abutting the wall portion 232 of the cap 215, the flow direction of the gas that flows in through the communicating hole 234 when the closed space is communicated with the atmosphere does not easily intersect the direction to which the ejecting ports 223 are open. Therefore, it is possible to suppress the occurrence of the liquid that splashes together with the flowing in of the gas adhering to the ejecting ports 223. When the direction to which the ejecting ports 223 are open does not intersect the direction to which the communicating hole 234 is open, since the liquid that splashes together with the opening to the atmosphere does not easily splash toward the ejecting ports 223, the liquid reception portion 252 may not be disposed in a position that opposes the communicating hole 234.

As in the second modification example illustrated in FIG. 5, the plurality of caps 215 may be provided to correspond to the plurality of nozzle groups G formed on one of the liquid ejecting units 213.

As in the second modification example illustrated in FIG. 5, the discharge flow path 217 that communicates with the suction mechanism 218 and the atmosphere-open flow path 220 that communicates with the atmosphere-open valve 219 may be connected to each of the plurality of caps 215.

Third Embodiment

Figure 11:
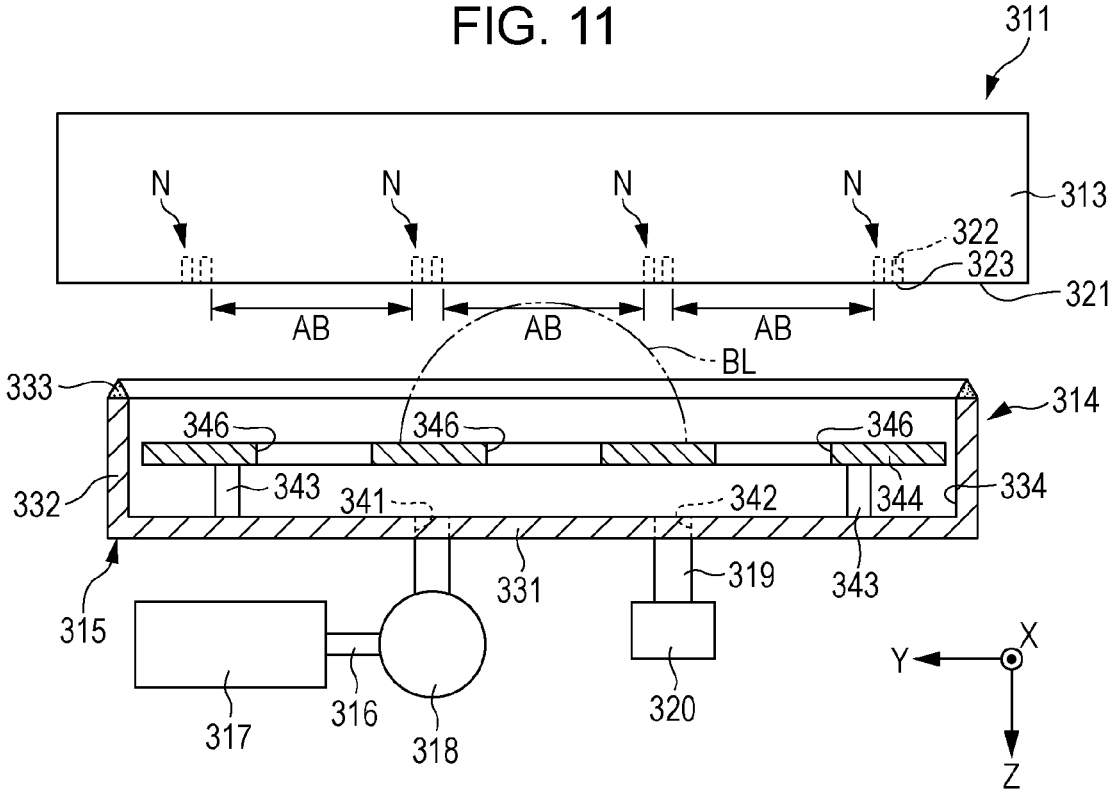
FIG. 11 is a cross-sectional diagram schematically illustrating a configuration of a liquid ejecting apparatus of a third embodiment.

As illustrated in FIG. 11, a liquid ejecting apparatus 311 is provided with a liquid ejecting unit 313 that ejects liquid, and a maintenance apparatus 314 for performing maintenance on the liquid ejecting unit 313. A plurality of nozzles 322 capable of ejecting liquid as droplets is provided in the liquid ejecting unit 313. The liquid ejecting unit 313 perform recording (printing) by ejecting the liquid from the nozzles 322 onto a medium (not shown).

The liquid ejecting unit 313 may be held by a carriage (not shown) that is capable of moving reciprocally in a width direction of the medium that intersects the transport direction of the medium, and may be a so-called line-head that has a width (length) corresponding to the width direction of the medium.

In the present embodiment, a direction in which the nozzles 322 eject the liquid is the ejecting direction Z. A plurality of ejecting ports 323 is formed in an opening surface 321 provided in the liquid ejecting unit 313. The ejecting ports 323 are the openings of the nozzles 322. The plurality of nozzles 322 lined up in a first direction X (the direction outward from the paper surface in FIG. 11) that intersects the ejecting direction Z form the nozzle row N (also refer to FIG. 13). A plurality of rows are provided in the liquid ejecting unit 313 so as to line up in a second direction Y (the left direction in FIG. 11) that intersects (for example, is perpendicular to) the ejecting direction Z and the first direction X.

In the present embodiment, the first direction X and the second direction Y are depicted as directions which are perpendicular to the ejecting direction Z; however, the angles of intersection of the first direction X, the second direction Y, and the ejecting direction Z can be changed arbitrarily. Note that, when the liquid ejecting unit 313 is held by a carriage (not shown) that is capable of moving reciprocally in the width direction of the medium that intersects the transport direction of the medium, the first direction X is the transport direction of the medium and the second direction Y is the width direction of the medium (the movement direction of the carriage). When the liquid ejecting unit 313 is a line-head that has a width (length) corresponding to the width direction of the medium, the first direction X is the width direction of the medium and the second direction Y is the direction of relative movement between the liquid ejecting unit 313 and the medium (the transport direction of the medium when the liquid ejecting unit 313 does not move).

In the present embodiment, a situation is exemplified in which the nozzle rows N are disposed at a predetermined interval in the first direction X two rows at a time; however, the nozzle rows N may be disposed at a predetermined interval in the first direction X one row at a time, and may be disposed at a predetermined interval in the first direction X in single units of three or more rows. Note that, in the liquid ejecting unit 313, a region between one nozzle row N and another, which are disposed with an interval therebetween in the second direction Y, is denoted as a region AB.

The maintenance apparatus 314 is provided with a cap 315, a collection body 317, a suction mechanism 318, and an atmosphere-open valve 320. The collection body 317 is connected to the cap 315 via a discharge flow path 316, the suction mechanism 318 is disposed in a position part way down the discharge flow path 316, and the atmosphere-open valve 320 is connected to the cap 315 via a ventilation flow path 319.

The cap 315 includes a bottom portion 331, a wall portion 332, and an elastically deformable lip portion 333, and has the shape of a box including a bottom in which the lip portion 333 forms an opening portion. The discharge flow path 316 and the ventilation flow path 319 are connected to the bottom portion 331, the wall portion 332 is provided to stand on the bottom portion 331, and the lip portion 333 is provided on the top edge of the wall portion 332. The bottom portion 331 and the wall portion 332 of the cap 315 form a liquid reservoir portion 334 capable of storing liquid.

A discharge hole 341 for discharging the liquid within the cap 315 is opened in the bottom portion 331 of the cap 315 in a position at which the discharge flow path 316 is connected. A ventilation hole 342 which communicates with the atmosphere-open valve 320 is opened in the bottom portion 331 of the cap 315 at a position at which the ventilation flow path 319 is connected. The discharge hole 341 and the ventilation hole 342 are through holes formed in the bottom portion 331, and the wall portion 332 is provided to stand on the bottom portion 331 so as to surround the discharge hole 341 and the ventilation hole 342 which are through holes.

Figure 12:
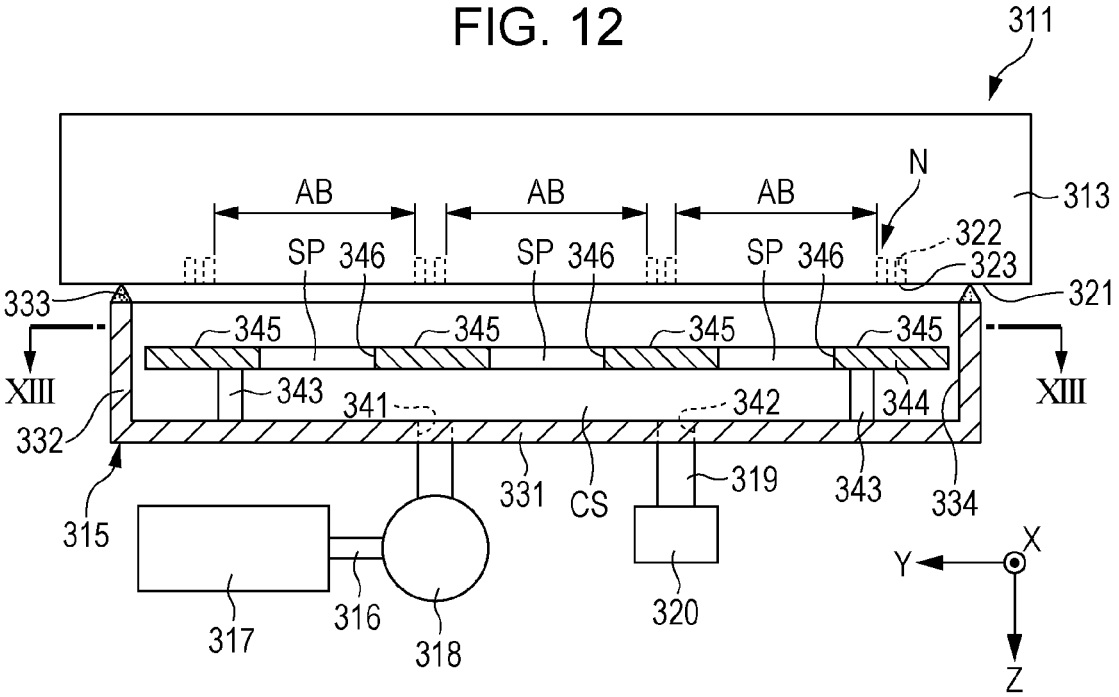
FIG. 12 is a cross-sectional diagram schematically illustrating the liquid ejecting apparatus in a capped state.

As illustrated in FIG. 12, of the cap 315 and the liquid ejecting unit 313, when one moves in a direction approaching the other, the lip portion 333 makes contact with the opening surface 321, and the cap 315 is formed to surround a closed space CS to which the plurality of ejecting ports 323 are open. Note that, forming the closed space CS to which the ejecting ports 323 are open using the cap 315 in this manner is referred to as "capping". When the cap 315 moves relatively in a direction going away from the liquid ejecting unit 313, the uncapping is performed.

Note that, the target that the cap 315 makes contact with when performing the capping is not limited to the opening surface 321. For example, it is possible to form the closed space CS to which the ejecting ports 323 are open by causing the side portions of the liquid ejecting unit 313 a member (not shown) that holds the liquid ejecting unit 313 to make contact with the cap 315.

When the liquid ejecting unit 313 is capped by the cap 315 and the suction mechanism 318 is driven in a state in which the atmosphere-open valve 320 is closed, the closed space CS is subjected to pressure reduction and assumes a negative pressure. Accordingly, the suction cleaning in which the liquid is discharged from the liquid ejecting unit 313 through the ejecting ports 323 is executed.

When, for example, the nozzles 322 become clogged or the like, and a liquid ejection fault occurs, the suction cleaning is performed as a maintenance operation for alleviating such an ejection fault. Therefore, the liquid that is discharged from the ejecting ports 323 by the suction cleaning contains bubbles that enter the liquid ejecting unit 313, a solute component with increased viscosity, or the like. The liquid that is discharged from the ejecting ports 323 in the suction cleaning is collected in the collection body 317 through the discharge flow path 316 as waste liquid.

After executing the suction cleaning, the uncapping is performed by causing the cap 315 to move relatively in a direction going away from the liquid ejecting unit 313 after releasing the negative pressure of the closed space CS by setting the atmosphere-open valve 320 to the open-valve state. Subsequently, the idle suction in which the liquid that remains in the liquid reservoir portion 334 is discharged into the collection body 317 through the discharge flow path 316 is performed by driving the suction mechanism 318.

In other words, the closed space CS is communicated with the atmosphere through the ventilation hole 342 due to the atmosphere-open valve 320 entering the open-valve state. Note that, a tube pump that includes a rotating member which rotates while crushing a tube, which serves as the discharge flow path 316, can be used as the suction mechanism 318, for example. In this case, it is possible to open the closed space CS to the atmosphere by releasing the tube from the crushing by the rotating member. When the suction mechanism 318 functions as an atmosphere-open mechanism, it is possible to allow gas to flow into the cap 315 through the discharge hole 341 that is a through hole, even if the ventilation hole 342, the ventilation flow path 319, and the atmosphere-open valve 320 are not provided.

There is a case in which flushing is performed as a maintenance operation for alleviating ejection faults. In the flushing, the liquid ejecting unit 313 ejects the droplets from the ejecting ports 323 toward the cap 315. Note that, the idle suction in which the liquid being stored in the liquid reservoir portion 334 is discharged into the collection body 317 through the discharge flow path 316 is performed by driving the suction mechanism 318 after performing the flushing.

A plurality of support shafts 343 are provided on the bottom portion 331 of the cap 315 to protrude therefrom. In an embodiment in which the cap 315 is supported by the support shafts 343, a plate-shaped liquid reception portion 344 is disposed within the cap 315. It is preferable that, when the cap 315 forms the closed space CS, the liquid reception portion 344 be disposed in a position suspended in the space within the cap 315 so as to be disposed in a position that opposes the ejecting ports 323 and is distanced from the bottom portion 331.

It is possible to form the liquid reception portion 344 using a porous material, for example. Note that, the liquid reception portion 344 is disposed in a position that is distanced from the discharge hole 341 that communicates with the suction mechanism 318; therefore, the suction force of the suction mechanism 318 does not easily reach the liquid reception portion 344. Therefore, it is preferable to configure the liquid reception portion 344 using a material that does not easily hold liquid. For example, it is preferable to adopt a configuration in which, even when the liquid reception portion 344 is formed using a porous material, the bubbles (cavities) of the inner portion are large, continuous or the like, and the absorbed liquid is discharged under its own weight.

When the cap 315 forms the closed space CS, a plurality of reception regions 345 that face the nozzle rows N are provided in the liquid reception portion 344 to correspond to the nozzle rows N. The plurality of reception regions 345 are disposed at an interval in the second direction Y such that spaces SP are formed in positions that oppose the regions AB between one nozzle row N of the liquid ejecting unit 313 and another.

In other words, when the cap 315 forms the closed space CS, the reception regions 345 of the liquid reception portion 344 are disposed between the bottom portion 331 and the nozzle rows N. In this embodiment, when the cap 315 forms the closed space CS, the discharge hole 341 and the ventilation hole 342 are communicated with the spaces SP.

When performing the suction cleaning, the liquid that is discharged from the liquid ejecting ports 323 is received by the liquid reception portion 344. The flushing is normally performed in the uncapped state; however, since the liquid reception portion 344 is provided in a position corresponding to the ejecting ports 323, the liquid that is ejected from the liquid ejecting unit 313 during the flushing is received by the liquid reception portion 344.

The liquid that is received by the liquid reception portion 344 flows down the liquid reception portion 344 and is stored in the liquid reservoir portion 334. In other words, the cap 315 holds the liquid for a period until the suction is performed by the suction mechanism 318 by storing the liquid that is discharged from the liquid ejecting unit 313 in the liquid reservoir portion 334.

Figure 13:
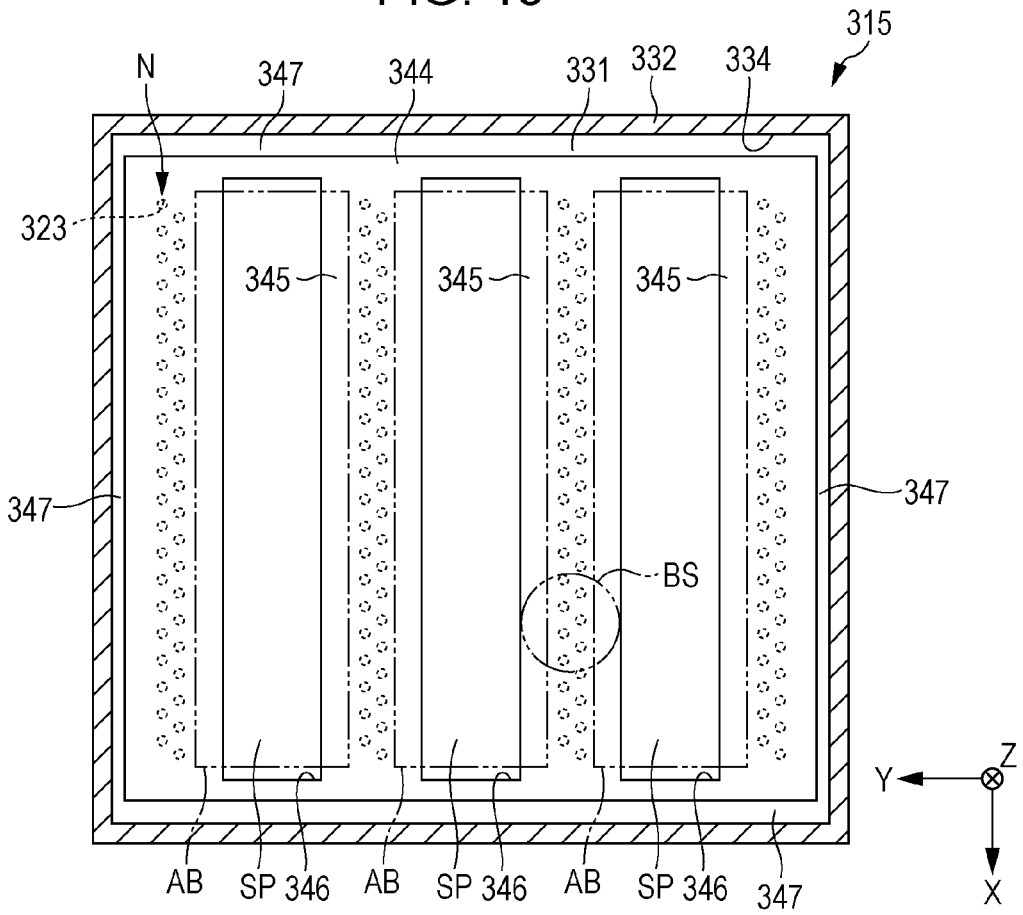
FIG. 13 is a cross-sectional view taken along line XIII-XIII in FIG. 12.

As illustrated in FIG. 13, in the present embodiment, a plurality of through holes 346 is formed in the liquid reception portion 344 in order to form the spaces SP; however, a plurality of the liquid reception portions 344 that extend in the first direction X may be disposed to line up in the second direction Y in order to form the spaces SP. It is preferable that the lengths of the liquid reception portion 344 in the first direction X and the second direction Y be smaller than those of the opening portion of the cap 315, so as to form a gap 347 between the liquid reception portion 344 and the wall portion 332.

Figure 14:
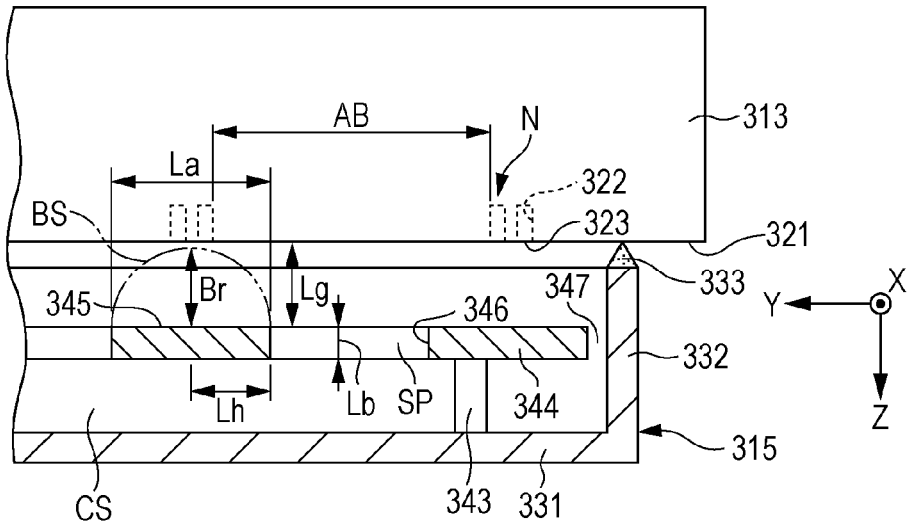
FIG. 14 is a cross-sectional view explaining the operation of the liquid ejecting apparatus.

As illustrated in FIG. 14, when the distance between the reception region 345 and the opening surface 321 of the liquid ejecting unit 313 when the cap 315 forms the closed space CS is Lg, and the length of the reception region 345 in the second direction Y is La, it is preferable that La/2<Lg. In other words, when La/2=Lh, it is preferable that Lh<Lg. When the length of the liquid reception portion 344 (the thickness of the liquid reception portion 344) in the ejecting direction Z is Lb, it is preferable that Lb<La.

Next, description will be given of the operations of the liquid ejecting apparatus 311, which is configured as described above.

In the suction cleaning, when the driving of the suction mechanism 318 is stopped, the liquid that is discharged from the ejecting ports 323 is stored in the cap 315. Therefore, when the cap 315 separates from the liquid ejecting unit 313, a film of the liquid is formed between the end portion of the opening surface 321 and the lip portion 333 of the cap 315, and as a result of the film being split into the liquid ejecting unit 313 side and the cap 315 side, as illustrated using the double-dot-dash line in FIG. 11, there is a case in which a large semi-spherical bubble BL that makes contact with the liquid reception portion 344 is formed. When the bubble BL makes contact with the ejecting ports 323 of the nozzles 322 during the next capping or the like, there is a concern that the liquid meniscus formed in the nozzles 322 will be disrupted and ejection faults will occur.

To address this point, when the space SP is present between one reception region 345 and another in the liquid reception portion 344, since the film is split by the space SP, a bubble does not form easily.

Even if a bubble BS that makes contact with the reception region 345 is formed as illustrated by the double-dot-dash line in FIG. 14, since the length (in the present embodiment, the length in the second direction Y) of the short side of the reception region 345 is the maximum value of the diameter of the bubble BS, the radius of the bubble BS is smaller than a case in which the spaces SP are not present. In other words, since the length of the bubble BS is short in the ejecting direction Z, the bubble BS does not easily make contact with the ejecting port 323 of the nozzles 322.

In particular, when La/2<Lg, since the maximum value Br=La/2=Lh of the radius of the bubble BS is shorter than the distance Lg between the reception region 345 and the liquid ejecting unit 313, the occurrence of the bubble BS making contact with the nozzles 322 is suppressed. Therefore, it is possible to suppress the occurrence of ejection faults caused by the bubble BS making contact with the meniscus of the nozzles 322.

When the suction cleaning is performed in the liquid ejecting apparatus 311, after opening the closed space CS to the atmosphere, there is a case in which the liquid that is discharged from the nozzles 322 remains as droplets that are adhered to the opening surface 321. When these droplets make contact with the droplets that are ejected from the nozzles 322, the flight direction of the droplets that are ejected from the nozzles 322 changes, and there is a case in which the print quality is reduced. To address this point, after the suction cleaning, the droplets are removed from the opening surface 321 by the liquid reception portion 344 that is disposed to oppose the ejecting ports 323 making contact with the droplets that are adhered to the opening surface 321, therefore, the reduction in the print quality caused by the droplets adhering to the opening surface 321 is suppressed.

Furthermore, when performing the flushing, the droplets that are ejected from the nozzles 322 are received by the liquid reception portion 344 before entering the liquid reservoir portion 334. When the flushing is performed, a fine mist is generated together with the droplets, and there is a case in which the fine mist adheres to the opening surface 321. When the mist gradually increases in size on the opening surface 321 and becomes droplets, these enlarged droplets make contact with the droplets that are ejected from the nozzles 322 and cause the flight direction of the ejected droplets to change, and there is a case in which the print quality is reduced. To address this point, if the droplets of the flushing are received by the liquid reception portion 344 that is disposed to be suspended between the opening surface 321 and the bottom portion 331, it is possible to suppress the generation of mist by the amount that it is possible to shorten the flight distance of the droplets that are ejected from the nozzles 322; therefore, this is preferable.

According to the embodiment described above, it is possible to obtain the following effects.

(1) Since the liquid reception portion 344 that is disposed within the cap 315 includes a plurality of the reception regions 345 that face the nozzle rows N when the cap 315 forms the closed space CS, the liquid that flows out from the nozzles 322 can be received by the reception regions 345. The plurality of reception regions 345 are disposed at an interval in the second direction Y that intersects the first direction X such that the spaces SP are formed in positions that oppose the regions AB in which the nozzle rows N of the liquid ejecting unit 313 are not formed. In other words, since the liquid reception portion 344 is not disposed in a position that opposes the region AB in which the nozzle rows N of the liquid ejecting unit 313 are not formed, even if the bubble BS is formed when the cap 315 separates from the liquid ejecting unit 313, the bubble BS is split by the space SP formed between the reception regions 345 in the second direction Y, and the diameter of the bubble BS is small. Accordingly, since the swelling of the bubble BS in the direction toward the nozzles 322 is suppressed, it is possible to suppress the occurrence of the bubble BS that is formed when the cap 315 separates from the liquid ejecting unit 313 adhering to the nozzles 322.

(2) Since the discharge hole 341 that is formed in the bottom portion 331 of the cap 315 communicates with the spaces SP that are formed between one of the reception regions 345 and another in the second direction Y, when the liquid that is discharged from the nozzles 322 is stored in the spaces SP, it is possible to discharge the liquid to the outside of the cap 315 through the discharge hole 341.

(3) Since the plurality of reception regions 345 that extend in the first direction X are disposed to line up in the second direction Y that is perpendicular to the first direction X, it is possible to reliably secure the space SP between one of the reception regions 345 and another that line up in the second direction Y.

(4) Since the liquid reception portion 344 is disposed in a position that is distanced from the bottom portion 331, it is possible to cause the liquid that is stored in the cap 315 to flow out through the discharge hole 341 quicker than when the liquid reception portion 344 is disposed in a position abutting the bottom portion 331.

(5) When the semi-spherical bubble BS is formed between the reception region 345 and the liquid ejecting unit 313 such that the end portion makes contact with the outer edge of the reception region 345, the wider the area of the reception region 345, the greater the maximum radius Br of the bubble BS that adheres to the same reception region 345. For example, when the length of the reception region 345 in the second direction Y is La, the maximum radius Br of the bubble BS that is adhered to the reception region 345 is La/2. When the liquid ejecting unit 313 approaches the reception region 345 to which the bubble BS is adhered, the likelihood that the bubble BS will make contact with the liquid ejecting unit 313 increases. To address this point, according to the embodiment described above, when the cap 315 approaches the liquid ejecting unit 313 and forms the closed space CS, since the distance Lg between the reception region 345 and the liquid ejecting unit 313 is greater than La/2, which is the radius of the bubble BS, the occurrence of the bubble BS making contact with the liquid ejecting unit 313 is suppressed.

(6) It is possible to decrease the size in the ejecting direction Z of the cap 315 in which the liquid reception portion 344 is disposed by reducing the length of the reception region 345 in the ejecting direction Z. Note that, since the liquid reception portion 344 of the embodiment described above is not an absorbent material for absorbing and holding the liquid, even if the size in the ejecting direction Z is decreased, the capability is not reduced.

(7) The liquid that is received by the liquid reception portion 344 formed of a porous material is absorbed into the liquid reception portion 344 through the holes formed in the liquid reception portion 344, passes through the liquid reception portion 344, and the like. Therefore, when the liquid reception portion 344 receives the liquid, it is possible to suppress the occurrence the liquid storing on the upper surface, which serves as the reception surface, of the liquid reception portion 344 and making contact with the nozzles 322.

Note that, the embodiment described above can also be modified as described below.

Figure 15:
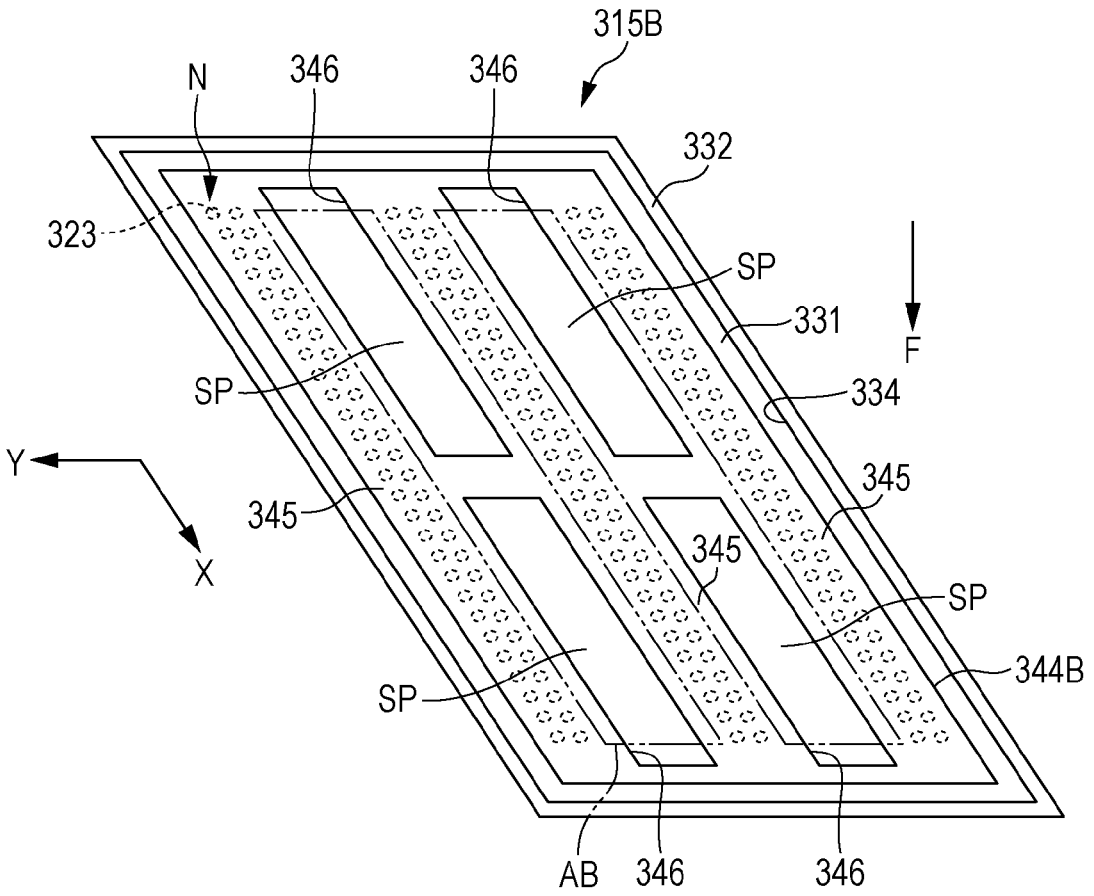
FIG. 15 is a diagram of a top surface illustrating a modification example of a cap.

As in the modification example illustrated in FIG. 15, the angle of intersection between the first direction X, in which the nozzles 322 that form the nozzle rows N line up, and the second direction Y, in which the plurality of nozzle rows N line up, is not limited to being 90°. In other words, the second direction Y may not be a direction that is perpendicular to the first direction X. The first direction X may diagonally intersect the transport direction F of the medium. The shapes of a cap 315B and a liquid reception portion 344B may be changed such that the cap 315B and the liquid reception portion 344B form parallelograms in plan view to correspond to the nozzle rows N.

As in the modification example illustrated in FIG. 15, the spaces SP that oppose the regions AB between one nozzle row N of the liquid ejecting unit 313 and another may be split in the direction (the first direction X) in which the nozzle rows N extend. For example, when the plurality of through holes 346 that line up in the direction (the first direction X) in which the nozzle rows N extend is provided in the liquid reception portion 344B, the spaces SP are split in the direction in which the nozzle rows N extend.

The liquid reception portion 344 may be engaged with the wall portion 332 without providing the support shafts 343 which support the liquid reception portion 344 in the cap 315.

The liquid reception portion 344 may be disposed to abut the bottom portion 331 without providing the support shafts 343 which support the liquid reception portion 344 in the cap 315. In this case, if the discharge hole 341 is disposed to communicate with the through holes 346 (the spaces SP), it is possible to quickly discharge the liquid that is stored in the spaces SP through the discharge hole 341.

Note that, when the liquid reception portion 344 that is formed of the porous material is disposed in a position abutting the bottom portion 331 so as to cover the ventilation hole 342, when a gas flows into the cap 315 through the ventilation hole 342, there is a concern that the liquid will form bubbles via the porous material. The bubbles that form via the porous material are not large single bubbles such as the bubbles BL and BS that are described in the embodiment above, and are a mass of a plurality of fine bubbles in contact with each other; however, even when such a mass of bubbles is formed, the occurrence of the bubbles adhering to the nozzles 322 is suppressed by the mass of bubbles being stored in the space SP.

When the bottom surface of the liquid reception portion 344 changes to a concave shape due to expansion of the liquid reception portion 344 or the like and the liquid stores in the gap created between the concave bottom surface and the bottom portion 331, a mass of bubbles is easily formed when gas flows in from the ventilation hole 342 that communicates with the gap. To address this point, if the liquid reception portion 344 (the reception regions 345) is disposed to leave an interval in the second direction Y, since the bottom surface of the liquid reception portion 344 does not easily deform into a concave shape in comparison to a case in which the liquid reception portion 344 is disposed continuously in the second direction Y, a gap does not form easily between the bottom surface of the liquid reception portion 344 and the bottom portion 331. In other words, it is possible to suppress the formation of bubbles when performing the atmosphere-opening through the ventilation hole 342 by suppressing the deformation of the liquid reception portion 344.

The disposition of the discharge hole 341 and the ventilation hole 342 in the cap 315 can be changed arbitrarily. For example, the discharge hole 341 and the ventilation hole 342 may be provided in the wall portion 332. Even in this case, it is preferable that the discharge hole 341 be disposed in a position close to the bottom portion 331 in order to discharge the liquid that is stored in the liquid reservoir portion 334.

It is possible to configure the liquid reception portion 344 using a mesh-shaped member such as wire netting or a textile, for example. In other words, the liquid reception portion 344 may be capable of making contact with the droplets after the suction cleaning or receiving the droplets during the flushing; therefore, the liquid reception portion 344 may be formed using a material that does not absorb the liquid. However, if the liquid reception portion 344 is capable of absorbing the liquid, it is possible to quickly remove the droplets from the opening surface 321 after the suction cleaning, to suppress the rebounding of the droplets received during the flushing, and the like.

The liquid that is ejected by the liquid ejecting units 13, 213, and 313 may be a liquid other than ink, and may be a liquid body in which particles of a functional material are dispersed or mixed in a liquid. For example, a configuration may be adopted in which the liquid ejecting unit 13, 213, or 313 ejects a liquid body, which contains a material such as an electrode material or a color material (pixel material) in the form of a dispersion or a solution, to perform recording. The electrode material or the color material may be used in the manufacture or the like of liquid crystal displays, Electro-Luminescence (EL) displays, and surface emission displays.

The medium is not limited to paper, may be a plastic film, a thin plate, or the like, and may be a fabric used in textile printing or the like.

The entire disclosure of Japanese Patent Application No. 2014-053144, filed Mar. 17, 2014 and Japanese Patent Application No. 2014-053145, filed Mar. 17, 2014 and Japanese Patent Application No. 2014-053146, filed Mar. 17, 2014 are expressly incorporated by reference herein.

What is claimed is:

1. A liquid ejecting apparatus, comprising:

a liquid ejecting unit capable of ejecting a liquid from a plurality of nozzles aligned in a nozzle row;

a plurality of liquid holding portions capable of holding the liquid that is discharged from the liquid ejecting unit; and a suction mechanism which is connected to the plurality of liquid holding portions, wherein the liquid holding portion includes a liquid reception portion which receives the liquid that is discharged from the liquid ejecting unit, a liquid reservoir portion capable of storing the liquid further down in a vertical direction than the liquid reception portion, and an atmosphere communicating portion which communicates the liquid reservoir portion with the atmosphere, wherein the liquid reception portion is accommodated inside the liquid holding portion and includes a through hole which forms a part of the atmosphere communicating portion, the through hole being disposed in a position that does not oppose the nozzle row.

2. The liquid ejecting apparatus according to claim 1, wherein the liquid reception portion is disposed to be suspended in a space within the liquid holding portion.

3. The liquid ejecting apparatus according to claim 1, wherein ejecting ports capable of ejecting a liquid as droplets are provided in the liquid ejecting unit, wherein the liquid holding portion is capable of forming a closed space to which the ejecting ports are open, and wherein the liquid reception portion is disposed in a position that opposes the ejecting ports when the liquid holding portion forms the closed space.

4. The liquid ejecting apparatus according to claim 1, wherein the liquid holding portion includes a bottom portion in which a suction hole that communicates with the suction mechanism is opened, and a wall portion which is provided to stand on the bottom portion so as to surround the suction hole, and wherein a gap which forms the atmosphere communicating portion is provided between the liquid reception portion and the wall portion.

5. The liquid ejecting apparatus according to claim 1, wherein the liquid holding portion includes a bottom portion in which a communicating hole that communicates with the suction mechanism is opened, and a wall portion which, by being provided to stand on the bottom portion, forms the liquid reservoir portion together with the bottom portion, and wherein an atmosphere-open valve which configures the atmosphere communicating portion is provided in the wall portion.

6. A liquid ejecting apparatus, comprising:

a liquid ejecting unit which includes ejecting ports capable of ejecting a liquid as droplets, the ejecting ports being aligned in a row;

a cap which forms a closed space containing the ejecting ports;

a suction mechanism which causes the liquid to be discharged from the ejecting ports by subjecting the closed space to pressure reduction; and an atmosphere-open mechanism for communicating the closed space with the atmosphere, wherein the cap includes a communicating hole which communicates with the atmosphere-open mechanism, and a liquid reception portion which is disposed between the ejecting ports and the communicating hole when forming the closed space, wherein the liquid reception portion is accommodated inside the liquid holding portion and includes a through hole which forms a part of the atmosphere communicating portion, the through hole being disposed in a position that does not oppose the row.

7. The liquid ejecting apparatus according to claim 6, wherein the cap includes a suction hole which communicates with the suction mechanism, a bottom portion in which the suction hole is opened, and a wall portion which is provided to stand on the bottom portion so as to surround the suction hole, wherein the bottom portion and the wall portion form a liquid reservoir portion capable of storing a liquid that is discharged from the ejecting ports, and wherein the liquid reception portion is disposed in a position that is distanced from the bottom portion.

8. The liquid ejecting apparatus according to claim 7, wherein the liquid reception portion is disposed so as to partition the closed space into a first region, which is on the liquid ejecting unit side, and a second region, which is on the bottom portion side and has a greater volume than the first region, wherein the first region and the second region communicate with each other through a gap that is provided between the liquid reception portion and the wall portion, and wherein the communicating hole is provided to be open to the second region.

9. The liquid ejecting apparatus according to claim 6, wherein the liquid reception portion includes a curved surface in a position that opposes the communicating hole, and wherein the curved surface is a convex shape so as to protrude toward the communicating hole.

10. The liquid ejecting apparatus according to claim 6, wherein the liquid reception portion includes a curved surface in a position that opposes the communicating hole, and wherein the curved surface is a concave shape so as to be concave toward the ejecting port side.

11. The liquid ejecting apparatus according to claim 6, wherein the liquid reception portion is disposed in a position that opposes the ejecting ports when the cap forms the closed space.

12. The liquid ejecting apparatus according to claim 6, wherein the cap includes a bottom portion in which the communicating hole is opened, a wall portion which is provided to stand on the bottom portion, and a lip portion which is provided on a top edge of the wall portion and forms the closed space by making contact with the liquid ejecting unit so as to surround the ejecting ports, and wherein the communicating hole is provided in a position abutting the wall portion.

13. A liquid ejecting apparatus, comprising:

a liquid ejecting unit in which a plurality of nozzle rows, which include a plurality of nozzles capable of ejecting liquid and which are formed by the plurality of nozzles being lined up in a first direction, are provided to line up in a second direction that intersects the first direction;

a cap which forms a closed space to which the plurality of nozzles are open; and a liquid reception portion which is disposed within the cap, wherein, when the cap forms the closed space, a plurality of reception regions that oppose the nozzle rows are provided in the liquid reception portion to correspond to the nozzle rows, and wherein the plurality of reception regions are disposed to leave an interval in the second direction such that through holes are formed in positions that oppose regions between one of the nozzle rows of the liquid ejecting unit and another in the reception portion.

14. The liquid ejecting apparatus according to claim 13, wherein the cap includes a bottom portion in which a discharge hole for discharging the liquid within the cap is opened, and a wall portion which is provided to stand on the bottom portion so as to surround the discharge hole, and wherein the discharge hole communicates with the spaces.

15. The liquid ejecting apparatus according to claim 13, wherein the second direction is a direction that is perpendicular to the first direction.

16. The liquid ejecting apparatus according to claim 13, wherein the cap includes a bottom portion in which a discharge hole for discharging the liquid within the cap is opened, and a wall portion which is provided to stand on the bottom portion so as to surround the discharge hole, and wherein the liquid reception portion is disposed in a position that is distanced from the bottom portion.

17. The liquid ejecting apparatus according to claim 13, wherein, when a distance between the reception region and the liquid ejecting unit when the cap forms the closed space is Lg, and a length of the reception region in the second direction is La, $La/2<Lg$.

18. The liquid ejecting apparatus according to claim 13, wherein the first direction and the second direction are directions that intersect with an ejecting direction in which the nozzles eject the liquid, and wherein, when a length of the reception region in the second direction is La, and a length of the liquid reception portion in the ejecting direction is Lb, $Lb<La$.

19. The liquid ejecting apparatus according to claim 13, wherein the liquid reception portion is formed of a porous material.

* * * * *